US007887054B2

(12) United States Patent
Daigo et al.

(10) Patent No.: US 7,887,054 B2
(45) Date of Patent: Feb. 15, 2011

(54) SHEET TRANSPORT DIRECTION SWITCHING DEVICE, AND IMAGE FORMING APPARATUS INCORPORATED WITH THE SAME

(75) Inventors: Hironori Daigo, Osaka (JP); Chisato Hatakeyama, Osaka (JP); Hiroshi Inui, Osaka (JP)

(73) Assignee: Kyocera Mita Corporation (JP)

( * ) Notice: Subject to any disclaimer, the term of this patent is extended or adjusted under 35 U.S.C. 154(b) by 0 days.

(21) Appl. No.: 12/411,190

(22) Filed: Mar. 25, 2009

(65) Prior Publication Data

US 2009/0243199 A1 Oct. 1, 2009

(30) Foreign Application Priority Data

Mar. 28, 2008 (JP) ..... 2008-087388

(51) Int. Cl.
*B65H 29/58* (2006.01)

(52) U.S. Cl. ..... 271/303; 271/301; 271/291

(58) Field of Classification Search ..... 271/303, 271/304, 291, 288, 298, 186, 301
See application file for complete search history.

(56) References Cited

U.S. PATENT DOCUMENTS 4,277,061 A * 7/1981 Nagel et al. ..... 271/302
4,871,163 A * 10/1989 Landa et al. ..... 271/225
4,925,178 A * 5/1990 Clabbers et al. ..... 271/186
5,868,387 A * 2/1999 Kida et al. ..... 271/304
5,927,713 A * 7/1999 Driscoll et al. ..... 271/298
6,572,105 B2 * 6/2003 Baker et al. ..... 271/303
6,764,236 B2 * 7/2004 Suzuki ..... 400/642
2004/0150158 A1 * 8/2004 Biegelsen et al. ..... 271/303

FOREIGN PATENT DOCUMENTS

JP 9-86759 3/1997
JP 2006-199452 8/2006

* cited by examiner

*Primary Examiner*—Kaitlin S Joerger
(74) *Attorney, Agent, or Firm*—Gerald E. Hespos; Michael J. Porco

(57) ABSTRACT

A sheet transport direction switching device includes: a rotary guide member having a single guide passage for passing a sheet to be transported, and a support shaft extending in a direction orthogonal to a transport direction of the sheet; and a posture changing mechanism for changing the posture of the rotary guide member. The rotary guide member is operable to change the posture thereof by pivotal movement about an axis of the support shaft so that an exit of the guide passage faces one of at least two discharge destinations. The posture changing mechanism has a stepping motor for pivotally moving the rotary guide member about the axis of the support shaft.

15 Claims, 12 Drawing Sheets

SHEET TRANSPORT DIRECTION SWITCHING DEVICE, AND IMAGE FORMING APPARATUS INCORPORATED WITH THE SAME

BACKGROUND OF THE INVENTION

1. Field of the Invention

The present invention relates to a sheet transport direction switching device for switching a transport direction of a sheet to be transported, and an image forming apparatus incorporated with the sheet transport direction switching device.

2. Description of the Related Art

Conventionally, there is known a sheet transport direction switching device, as recited in JP Hei 9-86759A, for use in a sheet transport system in an image forming apparatus. The sheet transport direction switching device is operable to switch a discharge destination of a sheet subjected to an image forming operation and carrying a toner image on a surface thereof between a discharge tray and a switchback path for a double-side printing operation, and a rotary guide member is provided at a branching position of the two destinations.

The rotary guide member is constituted of a pair of circular side plates disposed opposite to each other with a distance slightly larger than a sheet width, four guide plates mounted between the circular side plates, and rotating shafts extending in directions opposite to each other from the circular side plates. Three guide passages i.e. a middle straightforward guide passage, and two inverse guide passages defined at both sides of the middle straightforward guide passage are defined between each opposing pair of the guide plates. A sheet transported to the rotary guide member is selectively passed through one of the guide passages depending on a rotated amount of the rotary guide member with respect to a reference position thereof. The sheet is discharged to a predetermined destination depending on the selected guide passage.

The rotary guide member has such a complicated structure that the plural guide plates are mounted between the paired circular side plates. Accordingly, the material cost may be increased due to a large number of parts.

SUMMARY OF THE INVENTION

In view of the above, it is an object of the present invention to provide a sheet transport direction switching device capable of securing accurate pivotal operation of a rotary guide member, with a reduced number of parts.

A sheet transport direction switching device according to an aspect of the invention includes: a rotary guide member having a single guide passage for passing a sheet to be transported, and a support shaft extending in a direction orthogonal to a transport direction of the sheet; and a posture changing mechanism for changing the posture of the rotary guide member. The rotary guide member is operable to change the posture thereof by pivotal movement about an axis of the support shaft so that an exit of the guide passage faces one of at least two discharge destinations. The posture changing mechanism has a stepping motor for pivotally moving the rotary guide member about the axis of the support shaft.

An image forming apparatus according to another aspect of the invention includes: an image forming section for forming an image on a sheet; a main transport path for transporting the sheet via the image forming section; at least two sub transport paths defined at a downstream side of the main transport path; and a sheet transport direction switching device, disposed between the main transport path and the sub transport paths, for switching a transport direction of the sheet between the at least two sub transport paths, as discharge destinations, wherein the sheet transport direction switching device has the aforementioned arrangement.

These and other objects, features and advantages of the present invention will become more apparent upon reading the following detailed description along with the accompanying drawings.

BRIEF DESCRIPTION OF THE DRAWINGS

FIGS. 6A through 7B are diagrams for describing sheet guide postures of a rotary guide member as a first embodiment, wherein FIG. 6A shows a state that the rotary guide member is set to a reference posture, FIG. 7B shows a state that the rotary guide member is set to an inversion path oriented posture.

DETAILED DESCRIPTION OF THE PREFERRED EMBODIMENTS

First Embodiment

Figure 1:
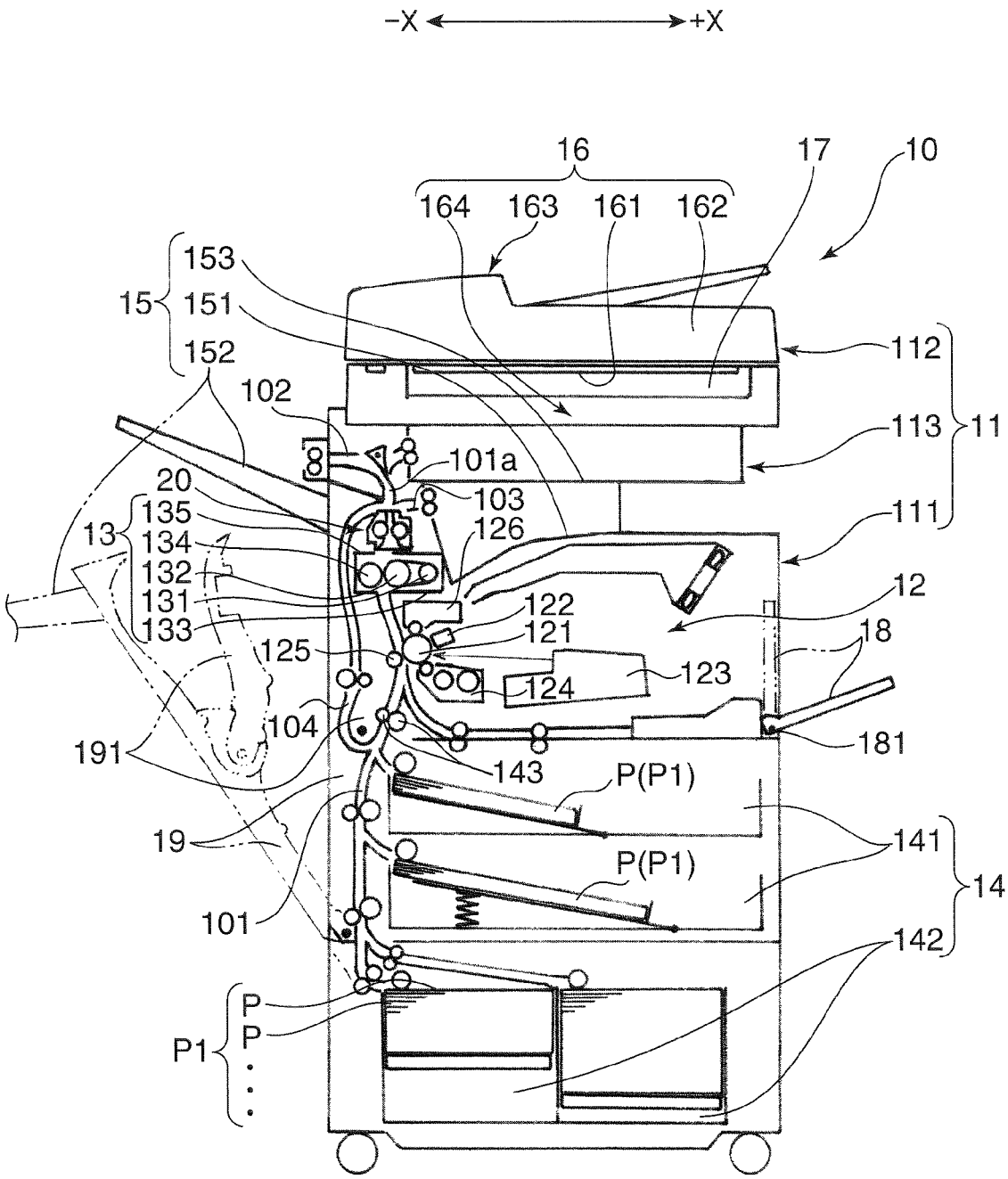
FIG. 1 is a front elevational view schematically showing an image forming apparatus incorporated with a sheet transport direction switching device embodying the invention.
Figure 2:
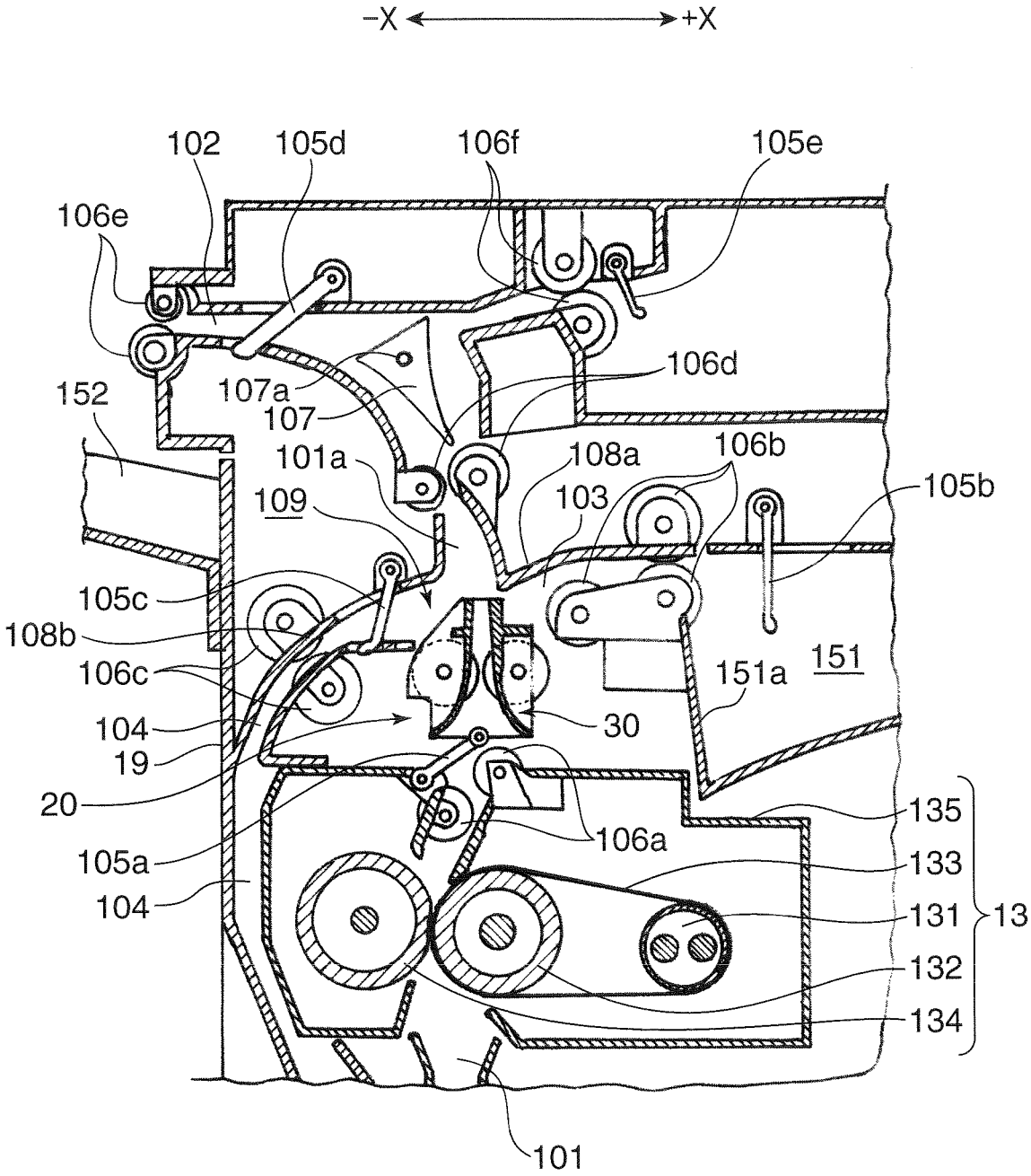
FIG. 2 is an enlarged view of the sheet transport direction switching device incorporated in the image forming apparatus shown in FIG. 1.

FIG. 1 is a front elevational view of an image forming apparatus 10 incorporated with a sheet transport direction switching device 20 in accordance with a first embodiment of the invention. FIG. 2 is an enlarged view of the sheet transport direction switching device 20 incorporated in the interior of an apparatus body 11 of the image forming apparatus 10, and peripheral parts thereof. In FIGS. 1 and 2, X-X directions are called as leftward and rightward directions, and particularly, −X direction is called as a leftward direction, and +X direction is called as a rightward direction.

The image forming apparatus 10 of the embodiment is a copying machine of a so-called internal discharge type. An image forming section 12, a fixing section 13, a sheet storing section 14, a sheet discharging section 15, an image reading section 16, and an operating section 17 are provided in the interior of the apparatus body 11. A part (i.e. an internal discharge tray 151 to be described later) of the sheet discharging section 15 is defined at a position beneath the image reading section 16 in the apparatus body 11.

The apparatus body 11 includes a rectangular parallelepiped lower body portion 111, a flat rectangular parallelepiped upper body portion 112 above the lower body portion 111 and opposite thereto, and a connecting portion 113 between the upper body portion 112 and the lower body portion 111. The connecting portion 113 connects the lower body portion 111 and the upper body portion 112 in a state that a space for the internal discharge tray 151 is defined between the lower body portion 111 and the upper body portion 112.

The image forming section 12, the fixing section 13, and the sheet storing section 14 are provided in the interior of the lower body portion 111. The image reading section 16 is mounted at the upper body portion 112. The operating section 17 projects in forward direction (in front direction on the plane of FIG. 1) from a front end of the upper body portion 112.

The operating section 17 is operable to accept input of information relating to an image forming operation. The operating section 17 is provided, on an upper surface thereof, a ten key for allowing a user to input the number of sheets P for image formation and the like, and various operation keys, as well as an LCD (Liquid Crystal Display) for allowing the user to input by touching.

The sheet storing section 14 includes sheet cassettes 141 detachably mounted in the lower body portion 111 at a position directly below the image forming section 12; and large capacity decks 142, detachably mounted in the lower body portion 111 at a position below the sheet cassettes 141, for storing a large number of sheets P. In this embodiment, two sheet cassettes 141 are provided one over the other, and two large capacity decks 142 are provided side by side. When an image forming operation is performed, a sheet P of a sheet stack P1 is dispensed from one of the sheet cassettes 141 and the large capacity decks 142, and fed to the image forming section 12. The sheet P fed to the image forming section 12 is subjected to an image forming operation (printing operation).

The sheet discharging section 15 includes the internal discharge tray (first discharge tray or switchback tray) 151 formed between the lower body portion 111 and the upper body portion 112, an external tray (second discharge tray) 152 formed on an exterior of the apparatus body 11, and an internal sheet finisher 153 provided at a position directly above the internal discharge tray 151. A sheet P transported from the image forming section 12 is selectively discharged to one of the internal discharge tray 151, the external tray 152, and the internal sheet finisher 153 via the sheet direction switching device 20 provided in a sheet transport direction switching section 109 defined in the interior of the connecting portion 113. The internal sheet finisher 153 is operable to perform a post-processing operation such as punching or stapling for discharged sheets P.

The internal discharge tray 151 is not only used as a tray for discharging a sheet P, but also used as a switchback tray for turning a sheet P upside down so as to print an image on the other side of a sheet P after an image is printed on one side of the sheet P in performing a double-side printing operation. Specifically, after an image is printed on one side of a sheet P, the sheet P is temporarily discharged to the internal discharge tray 151, is subjected to a switchback operation in a state that a trail end of the sheet P in a one-side printing operation serves as a lead end of the sheet P in an other-side printing operation, and is fed back to the image forming section 12. Thereafter, an image is printed on the other side of the sheet P in the image forming section 12, and the sheet P subjected to the double-side printing operation is discharged to the internal discharge tray 151 or the external tray 152.

The image reading section 16 includes a contact glass platen 161, mounted in an opening in a top wall of the upper body portion 112, for placing a document; an openable/closable document cover 162 for firmly holding the document placed on the contact glass platen 161; an automatic document transporter 163 mounted on the document cover 162; and a scan mechanism 164 for scanning an image of the document placed on the contact glass platen 161.

Image information of a document placed on the contact glass platen 161, or fed to the contact glass platen 161 by the automatic document transporter 163 is optically read by the scan mechanism 164 for conversion into an analog electrical signal. Thereafter, the analog signal is converted into a digital signal. The digital signal is outputted to an exposure unit 123, to be described later, for an image forming operation.

A manual tray 18 is mounted on a right wall of the lower body portion 111 at a position directly above the sheet storing section 14. The manual tray 18 is constructed in such a manner that a lower part thereof is pivotally movable about an axis of a support shaft 181 between a closing posture where the manual tray 18 stands upright to close a manual sheet feeding port of the image forming apparatus 10, and an opening posture where the manual tray 18 extends in rightward direction. When the manual tray 18 is set to the opening posture, a sheet P is manually fed. The sheet P fed from the manual tray 18 is transported toward a nip portion between a photosensitive drum 121 and a transfer roller 125 along a vertical transport path 101 (main transport path).

An openable/closable maintenance door 19 for maintenance service is mounted on a left wall of the lower body portion 111. The external tray 152 is mounted at a position above the maintenance door 19. A sheet P subjected to a printing operation in the image forming section 12 is selectively discharged to one of the external tray 152 and the internal discharge tray 151.

The image forming section 12 has the photosensitive drum 121 at a substantially middle position in vertical direction and at a slightly left position. A surface of the photosensitive drum 121 is uniformly charged by a charging unit 122 mounted at a position immediately to the right of the photosensitive drum 121, while the photosensitive drum 121 is rotated clockwise about an axis of rotation thereof.

The exposure unit 123 is provided at a position to the right of the photosensitive drum 121 to emit a laser beam to the surface of the photosensitive drum 121, based on image information relating to a document image read by the image reading section 16. An electrostatic latent image is formed on the surface of the photosensitive drum 121 by emission of the laser beam from the exposure unit 123. A toner is supplied to the electrostatic latent image from a developing unit 124 provided below the photosensitive drum 121. Thereby, a toner image based on the electrostatic latent image is formed on the surface of the photosensitive drum 121.

A sheet P is transported to the photosensitive drum 121 carrying a toner image on the surface thereof. Specifically, a sheet P fed from one of the sheet cassettes 141 and the large capacity decks 142 is guided upwardly along the vertical transport path 101 toward the photosensitive drum 121 by a registration roller pair 143 in synchronism with rotation of the registration roller pair 143. Then, the toner image on the surface of the photosensitive drum 121 is transferred onto the sheet P by an operation of the transfer roller 125 disposed opposite to the photosensitive drum 121 on the left side thereof. Then, the sheet P carrying the transferred toner image is transported to the fixing section 13.

After the toner image transferring operation on the sheet P is completed, the surface of the photosensitive drum 121 is subjected to a cleaning operation by a cleaning device 126 mounted at a position directly above the photosensitive drum 121. Thereafter, the surface of the photosensitive drum 121 is subjected to a charging operation for a succeeding image forming operation by the charging unit 122.

The fixing section 13 includes a heater roller 131 internally provided with an energizing heating element such as a halogen lamp; a fixing roller 132 disposed opposite to the heater roller 131 on the left side thereof; a fixing belt 133 wound around the fixing roller 132 and the heater roller 131; and a pressure roller 134 disposed opposite to the surface of the fixing belt 13 on the left side thereof. A casing member 135 encases the parts 131 through 134 therein. A sheet P transported from the image forming section 12 is subjected to a heating operation by the heater roller 131 via the fixing belt 133, while the sheet P is transported through a nip portion between the fixing belt 133 and the pressure roller 134. Thereby, the sheet P carrying a transferred toner image is subjected to a fixing operation.

In the case where a one-side printing operation is performed, a sheet P after a fixing operation is discharged onto the external tray (second discharge tray) 152 via the sheet transport direction switching device 20 in the sheet transport direction switching section 109 defined above the fixing section 13, and through a sheet discharge path (second sub transport path) 102; or onto the internal discharge tray (first discharge tray) 151 through a switchback path (first sub transport path) 103. In the case where a double-side printing operation is performed, a sheet P is temporarily discharged onto the internal discharge tray 151 serving as a switchback tray through the switchback path 103.

Specifically, in the case where a double-side printing operation is performed, after a first half of a sheet P subjected to a one-side printing operation is temporarily discharged onto the internal discharge tray 151 through the switchback path 103, the sheet P is transported in backward direction through a vertically extending inversion path 104 in the interior of the maintenance door 19. Thereafter, the sheet P is transported to the image forming section 12 in a state that the surface of the sheet P is turned upside down for printing an image on the other side of the sheet P. The sheet P subjected to the double-side printing operation is discharged onto the internal discharge tray 151 or the external tray 152.

The maintenance door 19 has a cover member 191 at a position immediately to the right of the inversion path 104, with a right wall of the cover member 191 facing a left wall of the image forming section 12. When the maintenance door 19 is set to a closing posture, a part of the vertical transport path 101 for transporting a sheet P via the image forming section 12 is defined between the right wall of the cover member 191 and the left wall of the image forming section 12.

By providing the maintenance door 19 equipped with the cover member 191, if a sheet P is jammed in the vertical transport path 101 corresponding to the left wall of the image forming section 12, the sheet P is exposed to the outside by setting the maintenance door 19 to an opening posture. Thereby, the user is allowed to easily remove the jammed sheet P.

As shown in FIG. 2, the sheet transport direction switching section 109 is defined at a position directly above the casing 135 of the fixing section 13, and in a space to the left of a left wall 151*a* equipped with the internal discharge tray 151. The sheet transport direction switching device 20 is mounted in the sheet transport direction switching section 109 in a manner that the posture of the sheet transport direction switching device 20 is changeable. Specifically, a first arc guide plate 108*a* is formed at an upper right position of the sheet transport direction switching section 109, and a second arc guide plate 108*b* is formed at an upper left position of the sheet transport direction switching section 109. The first arc guide plate 108*a* is a downwardly curved member extending outwardly toward the internal discharge tray 151 with respect to an upper end of the left wall 151*a* of the internal discharge tray 151. The second arc guide plate 108*b* is a downwardly curved member for guiding a sheet P to the inversion path 104 defined on the left of the fixing section 13 and below the sheet transport direction switching device 20.

A clearance is defined between a left end of the first arc guide plate 108*a* and a right end of the second arc guide plate 108*b* to pass a sheet P discharged upwardly from the fixing section 13. An upper end transport path 101*a* communicating with the sheet discharge path 102 is defined in an upper region of the clearance.

A switching guide member 107 substantially shaped like an isosceles triangular is mounted at a position directly above the upper end transport path 101*a*. The switching guide member 107 is operable to switch a discharge destination of a sheet P through the upper end transport path 101*a* between the internal sheet finisher 153 and the external tray 152. The switching guide member 107 is mounted in such a manner that a position of the switching guide member 107 corresponding to an apex of the isosceles triangle is directed in downward direction.

The switching guide member 107 is movable between a finisher oriented posture for guiding a sheet P to the internal sheet finisher 153 along a right surface of the switching guide member 107 by clockwise pivotal movement thereof about an axis of a guide rod 107*a* defined at a substantially centroid position of the switching guide member 107; and an external tray oriented posture for guiding a sheet P to the external tray 152 along a left surface of the switching guide member 107 by counterclockwise pivotal movement thereof about the axis of the guide rod 107*a*.

As described above, after a sheet P subjected to an image forming operation in the image forming section 12, and a fixing operation in the fixing section 13 is temporarily guided to the sheet transport direction switching section 109, the sheet P is discharged to an intended destination depending on an intended image forming operation or an execution of post-processing operation. In this embodiment, the sheet transport direction switching device 20 including a rotary guide member 30 provided with a single guide passage 320 for passing a sheet P is provided in the sheet transport direction switching section 109 to discharge the sheet P to an intended destination.

Multiple transport rollers are provided in the vicinity of the sheet transport direction switching device 20 to smoothly guide a sheet P in and out of the sheet transport direction switching device 20 by transport operations of the transport rollers. The transport rollers are: a fixing section exit roller pair 106*a* disposed at an exit of the fixing section 13 and at a position immediately upstream of the sheet transport direction switching device 20; a first discharge roller pair (roller pair) 106*b*, disposed at a lower position of the first arc guide plate 108*a* i.e. above the switchback path 103, and immediately an upstream portion of the internal discharge tray 151, for aiding discharge of a sheet P to the internal discharge tray 151; an inversion path oriented transport roller pair 106*c*, disposed at a lower position of the second arc guide plate 108*b*, for aiding transport of a sheet P toward the inversion path 104; a switching guide member oriented transport roller pair 106*d*, disposed at a downstream end of the upper end transport path 101*a* and at a position immediately below the switching guide member 107, for aiding transport of a sheet P toward the switching guide member 107; a second discharge roller pair 106*e* disposed at an upstream end of the external tray 152; and a third discharge roller pair 106*f* disposed at an entrance of the internal sheet finisher 153.

Various sheet sensors are provided in the vicinity of the sheet transport direction switching device 20 to detect a transport status of a sheet P in and out of the sheet transport direction switching device 20. The sheet sensors are: an internal guide sensor (first sensor) 105*a*, a first discharge sensor 105*b*, an inversion sensor 105*c* (second sensor), a second discharge sensor 105*d*, and a third discharge sensor 105*e*.

The internal guide sensor 105*a* is a light sensor provided with a light blocking member which swings about a downstream end of the fixing section 13 i.e. an upper part of the casing 135 of the fixing section 13, as a pivot. The other sheet sensors are light sensors having the same construction as that of the internal guide sensor 105*a*. A lead end of the light blocking member is allowed to enter the guide passage 320 (see FIG. 5) of the rotary guide member 30. Thereby, the internal guide sensor 105*a* is operable to detect that a lead end of a sheet P in a transport direction has entered the guide passage 320.

The first discharge sensor 105*b* is provided at an entrance of the internal discharge tray 151 to detect whether a sheet P is discharged onto the internal discharge tray 151. The inversion sensor 105*c* is provided at an upstream end of the inversion path 104 to detect whether a lead end of a sheet P in the transport direction has entered the inversion path 104. The second discharge sensor 105*d* is provided near the second discharge roller pair 106*e* to detect whether a sheet P is about to be discharged toward the external tray 152. The third discharge sensor 105*e* is provided near the third discharge roller pair 106*f* at an entrance of the internal sheet finisher 153 to detect whether a sheet P has been transported to the internal sheet finisher 153.

A sheet P transported from the fixing section 13 by detecting operations of the sheet P by the sensors 105*a* through 105*e*, and predetermined operations by the sheet transport direction switching device 20 and the switching guide member 107 based on the detection results of the sensors 105*a* through 105*e* is transported to a predetermined destination.

Figure 3:
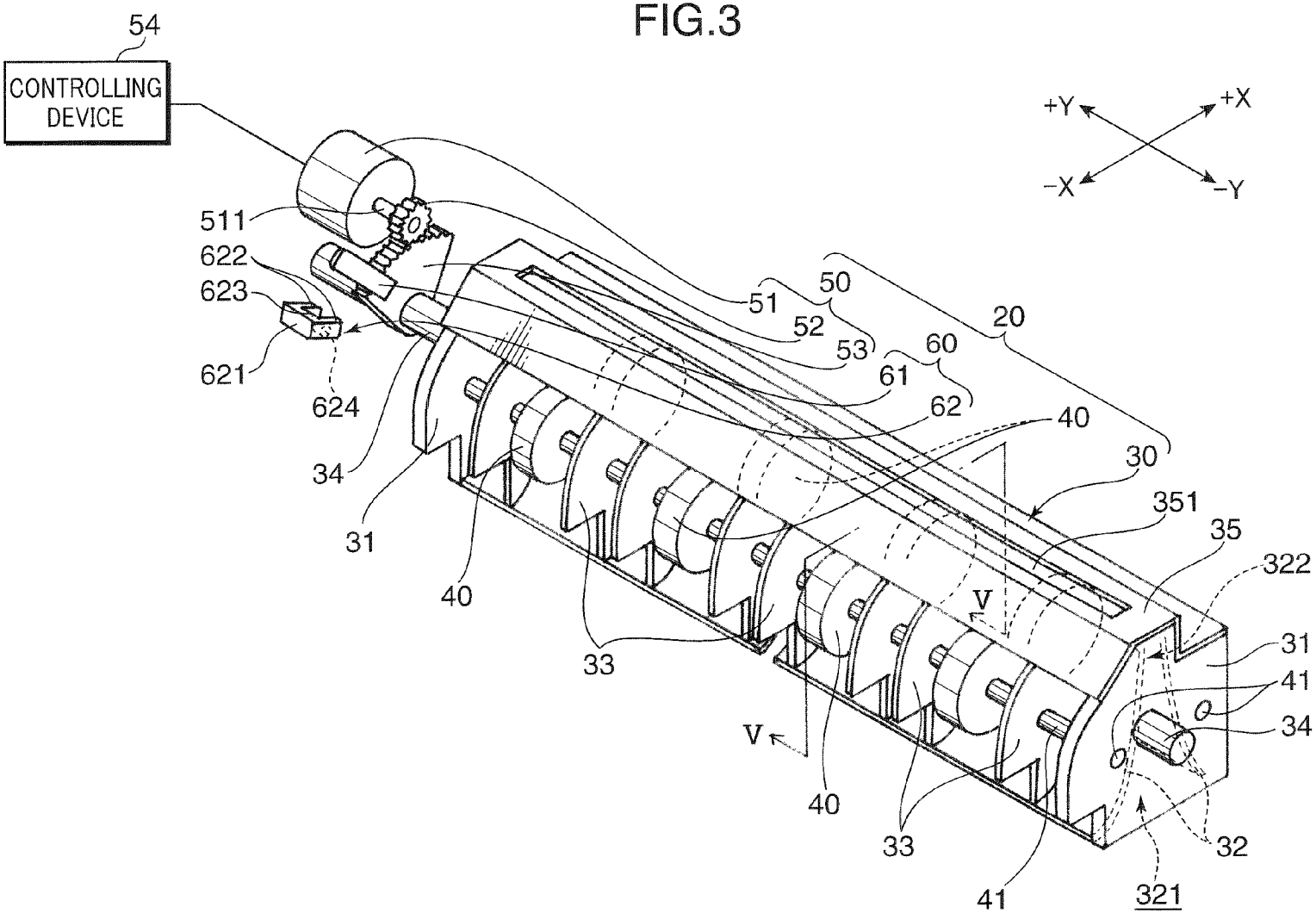
FIG. 3 is a perspective view of the sheet transport direction switching device, viewed from obliquely above.
Figure 4:
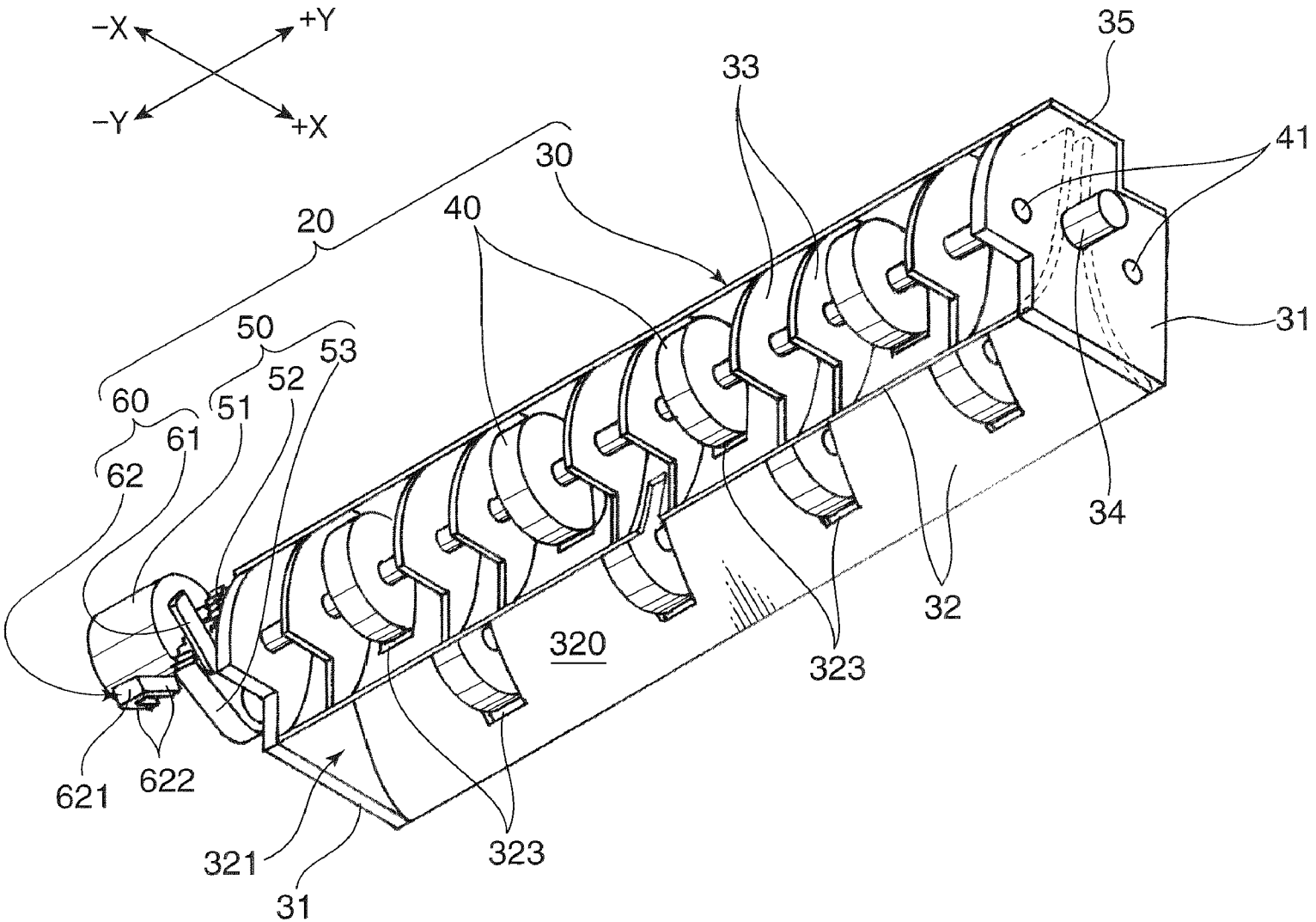
FIG. 4 is a perspective view of the sheet transport direction switching device shown in FIG. 3, viewed from obliquely below.
Figure 5:
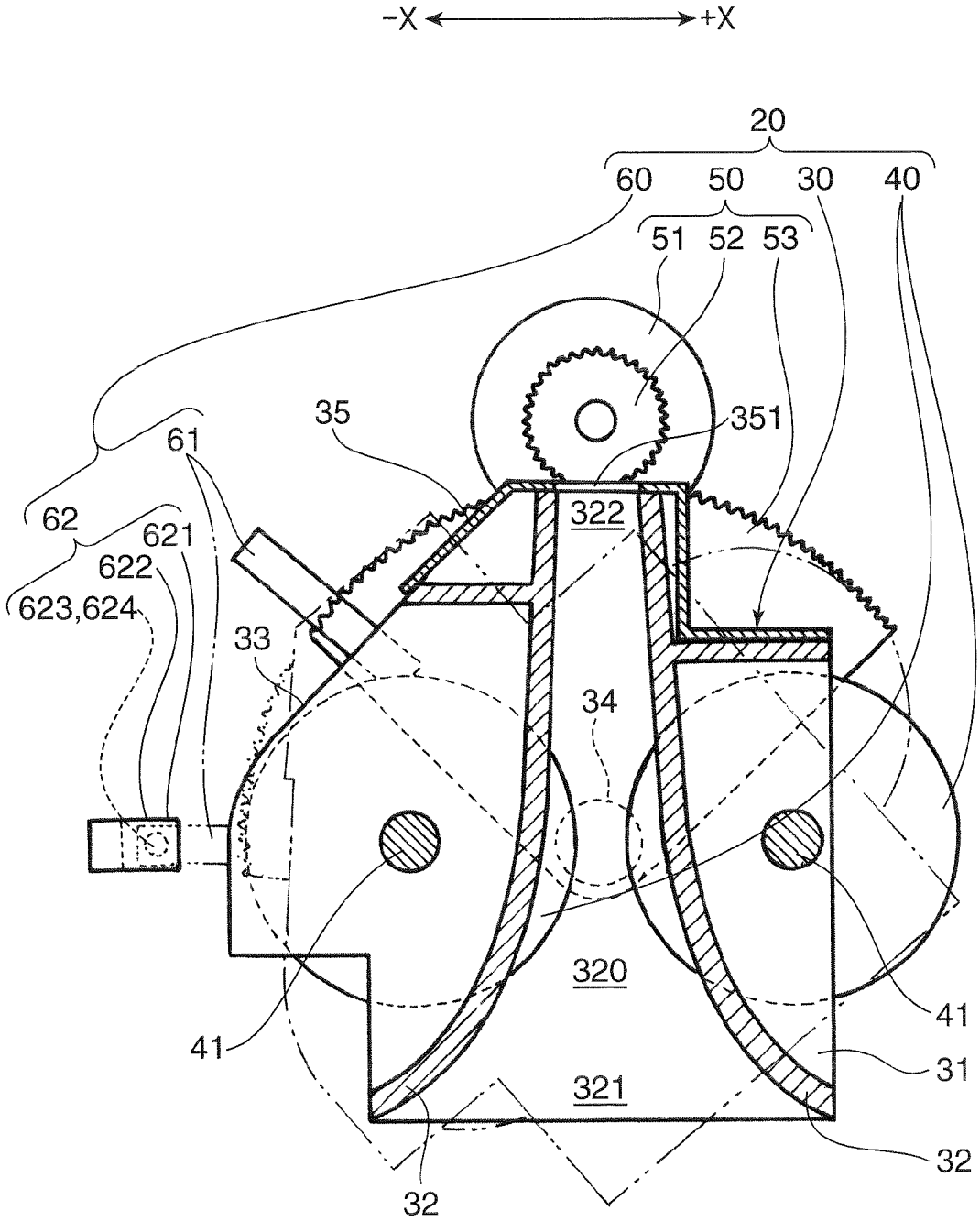
FIG. 5 is a cross-sectional view of the sheet transport direction switching device taken along the line V-V in FIG. 3.

In the following, the sheet transport direction switching device 20 is described referring to FIGS. 3 through 5. FIGS. 3 and 4 are perspective views of the sheet transport direction switching device 20. FIG. 3 is a diagram viewed from obliquely above, and FIG. 4 is a diagram viewed from obliquely below. FIG. 5 is a cross-sectional view of the sheet transport direction switching device 20 taken along the line V-V in FIG. 3, wherein a member indicated by the two-dotted chain line is the rotary guide member 30 in a reference posture S1, and a member indicated by the solid line is the rotary guide member 30 in an upright posture S2. In FIGS. 3 through 5, X-X directions are called as leftward and rightward directions, and Y-Y directions are called as forward and backward directions. In particular, −X direction is called as a leftward direction, +X direction is called as a rightward direction, −Y direction is called as a forward direction, and +Y direction is called as a backward direction.

The sheet transport direction switching device 20 includes the rotary guide member 30, guide pulleys 40, a posture changing mechanism 50, and a reference position detector 60. The rotary guide member 30 is operable to receive a sheet P transported from the fixing section 13 (see FIG. 2) by the fixing section exit roller pair 106*a*, and guide discharge of the sheet P to a predetermined destination (at least one of two destinations). The guide pulleys 40 are mounted in the rotary guide member 30 to guide a sheet P in such a manner as not to give an adverse effect to a toner image on the sheet P. The posture changing mechanism 50 is operable to change the posture of the rotary guide member 30 by pivotally moving the rotary guide member 30 in forward or backward direction about axes of predetermined guide shafts (support shafts) 34. The reference position detector 60 is operable to detect a reference position of the rotary guide member 30 whose posture is changed by the posture changing mechanism 50.

The rotary guide member 30 includes a pair of side plates 31 disposed opposite to each other in forward and backward directions; a pair of arc guide plates 32 disposed opposite to each other in leftward and rightward directions between the side plates 31; multiple guide fins 33 fixed to the left arc guide plate 32 and arrayed in forward and backward directions; the paired guide shafts 34 coaxially extending in opposite directions from each other at substantially centroid positions of the front and rear side plates 31; and a cover member 35 mounted between upper ends of the side plates 31.

Each of the side plates 31 has a basically square shape in front view, with some parts thereof being cutaway. Specifically, the side plate 31 is formed by cutting an upper left corner of a square side plate into an outwardly convex arc shape, and cutting away an upper right corner and a lower left corner thereof into a rectangular shape. The left and right arc guide plates 32 mounted between the side plates 31 serve as a structural member to impart a structural strength to the rotary guide member 30.

The arc guide plates 32 are disposed opposite to each other with a clearance to define the single guide passage 320 for guiding a sheet P transported from the fixing section 13. The arc guide plates 32 each has an arc surface extending in a direction of the guide passage 320. With the formation of the arc surfaces, the distance between the guide plates 32 is increased at lower ends thereof in front view, and gradually decreased in upward direction.

An opening at lower ends of the opposing arc guide plates 32 serves as a receiving opening (entrance of the guide passage) 321 for allowing entry of a sheet P transported from the fixing section 13, and an opening at upper ends thereof serve as a discharge opening (exit of the guide passage) 322 for discharging a sheet P. A sheet P transported from the fixing section 13 is guided to the guide passage 320 through the receiving opening 321 via the internal guide sensor 105*a*, and discharged upwardly through a discharge port (exit of the guide passage) 351, to be described later, which is formed in the cover member 35 and communicates with the discharge opening 322. A sheet P discharged through the discharge port 351 via the guide passage 320 in the rotary guide member 30 is guided to a predetermined destination depending on the posture of the rotary guide member 30, which is described later in detail.

The guide fins 33 are operable to guide a sheet P from the internal discharge tray 151 toward the inversion path 104 for a double-side printing operation, after the sheet P is temporarily discharged on the internal discharge tray 151, in a state that the rotary guide member 30 is set to an inversion path oriented posture S4 (see FIG. 7B), which is described later. Upper ends (guide surfaces) of the guide fins 33 are formed into a convex arc shape in the similar manner as the upper ends of the side plates 31. In this arrangement, an upstream end of the inversion path 104 is defined by the upper ends of the guide fins 33 and the downwardly curved second arc guide plate 108*b* when the rotary guide member 30 is set to the inversion path oriented posture S4. In this embodiment, eight guide fins 33 are provided, but the number of guide fins 33 may be optionally set.

The paired guide shafts 34 are supported on an unillustrated frame of the apparatus body 11, and integrally and pivotally moved along with the rotary guide member 30 about the axes of the guide shafts 34 by the posture changing mechanism 50.

The cover member 35 is formed by bending a sheet metal, and is adapted to reinforce the rotary guide member 30 for preventing deformation of the rotary guide member 30 by application of an external force, and prevent intrusion of foreign matters such as dusts into the rotary guide member 30. As shown in FIG. 3, the cover member 35 covers an upper part of the rotary guide member 30, and extends between the upper ends of the side plates 31 in FIG. 3. The discharge port 351 extending in forward and backward directions for discharging a sheet P is formed in a top part of the cover member 35 at a position opposing to the discharge opening 322 defined by the arc guide plates 32.

Two arrays of the guide pulleys 40 are provided in plural positions between front and back, with the left and right arc guide plates 32 being interposed therebetween. In the example shown in FIGS. 3 and 4, four guide pulley pairs 40 in leftward and rightward directions are provided. Alternatively, three or less, or five or more guide pulley pairs 40 may be provided.

Each of the paired guide pulleys 40 are rotatably supported about axes of a pair of left and right pulley shafts 41. The paired pulley shafts 41 extend between the side plates 31 at left and right outer positions of the left and right paired arc guide plates 32, respectively, in a state that the left pulley shaft 41 extends through the guide fins 33.

As shown in FIG. 4, through windows 323 are formed in the left and right arc guide plates 32 at positions corresponding to the guide pulleys 40. Individually parts of the guide pulleys 40 are projected in the guide passage 320 defined by the arc guide plates 32 through the through windows 323. Thereby, parts of the surfaces of the paired guide pulleys 40 oppose to each other in the guide passage 320.

In this arrangement, a sheet P transported from the fixing section 13 passes a clearance between the opposing surfaces of the left and right pairs of the guide pulleys 40 without a likelihood that both surfaces of the sheet P may be contacted with the arc guide plates 32, when the sheet P is guided into the guide passage 320 through the receiving opening 321. In passing the clearance, even if an image forming surface of the sheet P is contacted with the surfaces of the corresponding array of the guide pulleys 40, there is no likelihood that the image forming surface of the sheet P may be contacted with an inner wall of the corresponding arc guide plate 32, because the guide pulleys 40 are rotated about the axes of the pulley shafts 41 by the contact. Thus, the arrangement prevents an improper image formation by contact of the arc guide plate 32 with a toner image formed on a sheet P.

The posture changing mechanism 50 is a mechanism for setting the posture of the rotary guide member 30. The posture changing mechanism 50 includes a stepping motor 51, a drive gear 52 integrally and coaxially rotatably mounted on a drive shaft 511 of the stepping motor 51, a section gear 53 integrally and pivotally fixed to the rear guide shaft 34 and in mesh with the drive gear 52, and a controlling device 54 (shown in FIG. 3) for controlling an operation of the stepping motor 51.

The stepping motor 51 is operable to pivotally move the rotary guide member 30 about the axes of the guide shafts 34 by drivingly rotating the guide shafts 34. A rotation angle of the stepping motor 51 is determined depending on the number of pulses contained in a pulse signal to be supplied from the controlling device 54. The controlling device 54 outputs, to the stepping motor 51, a pulse signal corresponding to a pivotal amount of the rotary guide member 30 which is predefined depending on a discharge destination of a sheet P. In this arrangement, the rotation angle of the stepping motor 51 i.e. the posture of the rotary guide member 30 is precisely controlled. Unlike a conventional arrangement that the posture of a guide member is changed by e.g. on/off control of electric power supply to a solenoid, use of the stepping motor 51 having the above arrangement not only precisely changes the posture of the rotary guide member 30 but also suppresses generation of abnormal sounds.

The stepping motor 51 is horizontally mounted at an upper rear position of the rotary guide member 30, with the drive shaft 511 extending in forward direction. A driving force of the stepping motor 51 is transmitted to the rotary guide member 30 via the drive gear 52 and the section gear 53. In this arrangement, driving the stepping motor 51 in forward or backward direction pivotally moves the rotary guide member 30 about the axes of the guide shafts 34, thereby changing the posture of the rotary guide member 30.

The reference position detector 60 includes a light blocking member 61 and a light sensor 62. The light blocking member 61 radially and outwardly extends from the section gear 53. The light sensor 62 is disposed on a pivotal orbit of the light blocking member 61 about the axis of the rear guide shaft 34 in such a manner that the light sensor 62 opposes the light blocking member 61 when the rotary guide member 30 is set to the reference posture S1 (see FIG. 6A), as a home position.

The light sensor 62 is constructed in such a manner that a light emitting element 623 and a light receiving element 624 are mounted as opposed to each other in a two-legged support casing 621 provided with a pair of element support arms 622. The support casing 621 is positioned in such a manner that the pivotal orbit of the light blocking member 61 is partially overlapped with the element support arms 622; and that the light blocking member 61 is interposed between the paired element support arms 622 when the rotary guide member 30 is set to the reference posture S1. The light emitting element 623 is mounted on one of the element support arms 622, and the light receiving element 624 is mounted on the other of the element support arms 622 as opposed to the light emitting element 623.

In this arrangement, in the case where the rotary guide member 30 is not set to the reference posture S1, light from the light emitting element 623 is received by the light receiving element 624. Thereby, the reference position detector 60 is operable to detect that the rotary guide member 30 is not set to the reference posture S1. On the other hand, in the case where the rotary guide member 30 is set to the reference posture S1, the light blocking member 61 is interposed between the paired element support arms 622, and light from the light emitting element 623 is interrupted by the light blocking member 61. As a result, the light receiving element 624 is incapable of receiving light from the light emitting element 623. Thereby, the reference position detector 60 is operable to detect that the rotary guide member 30 is set to the reference posture S1.

Figure 6A:
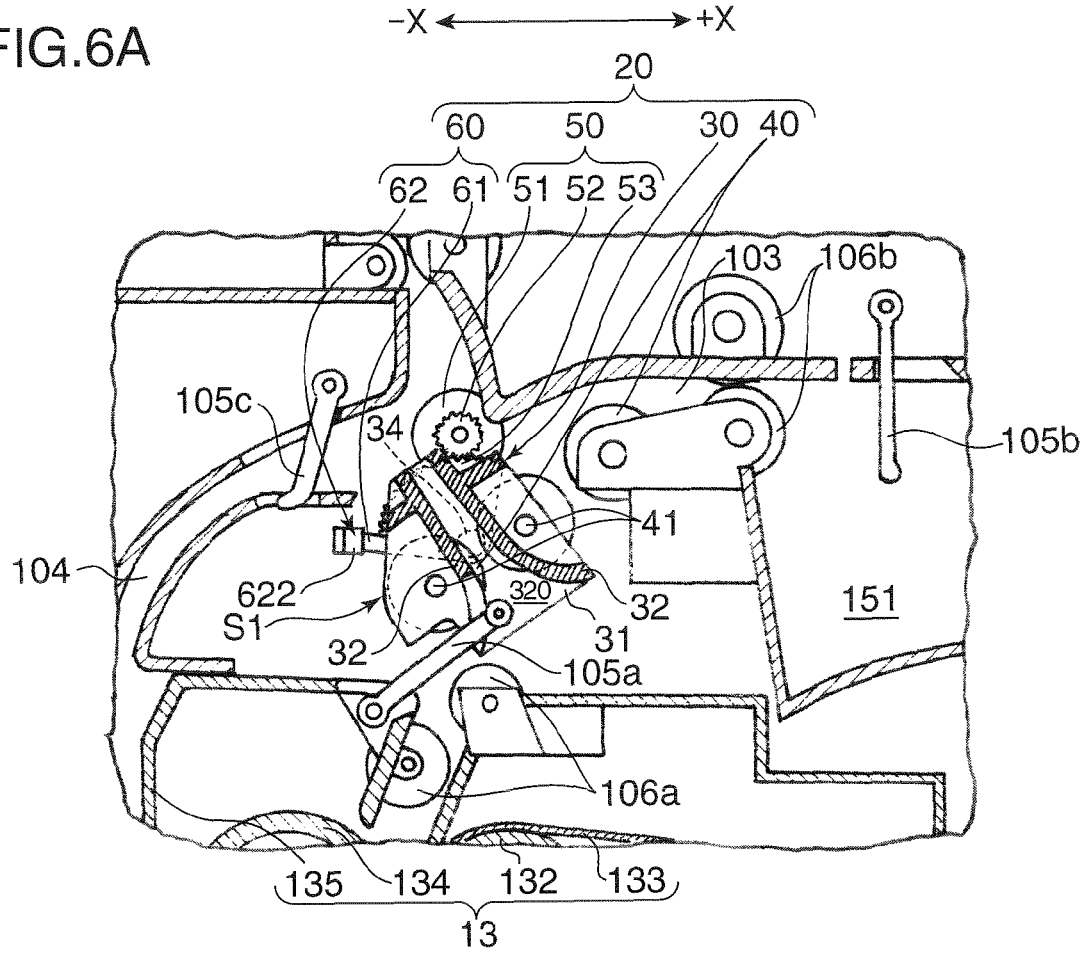
Figure 6B:
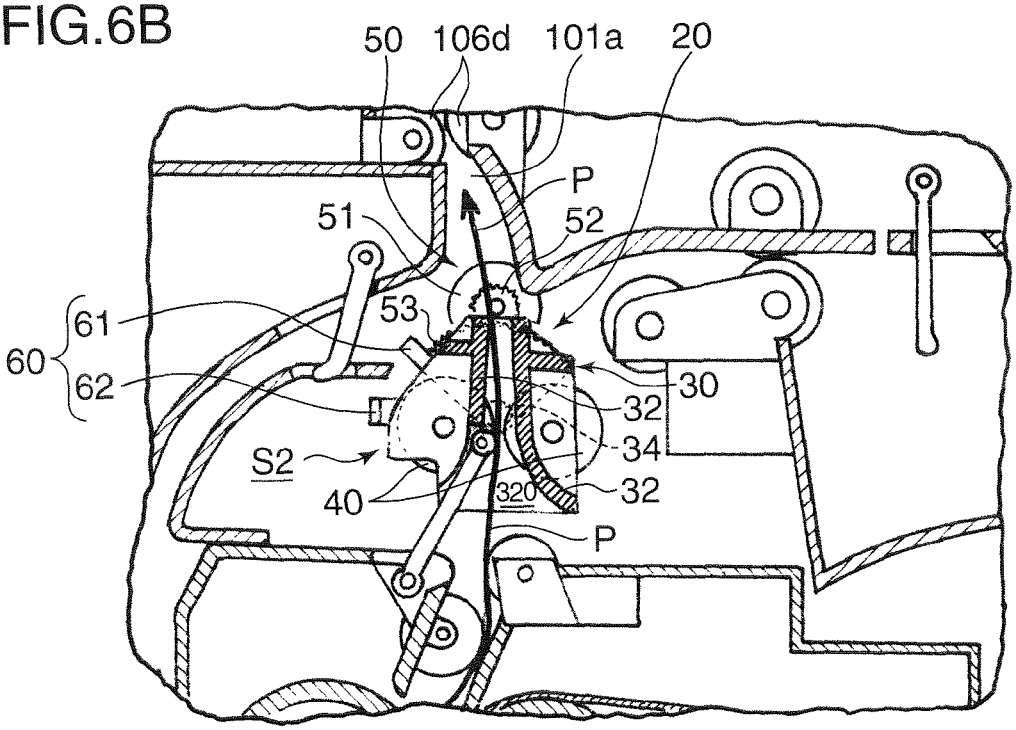
FIG. 6B shows a state that the rotary guide member is set to an upright posture.
Figure 7A:
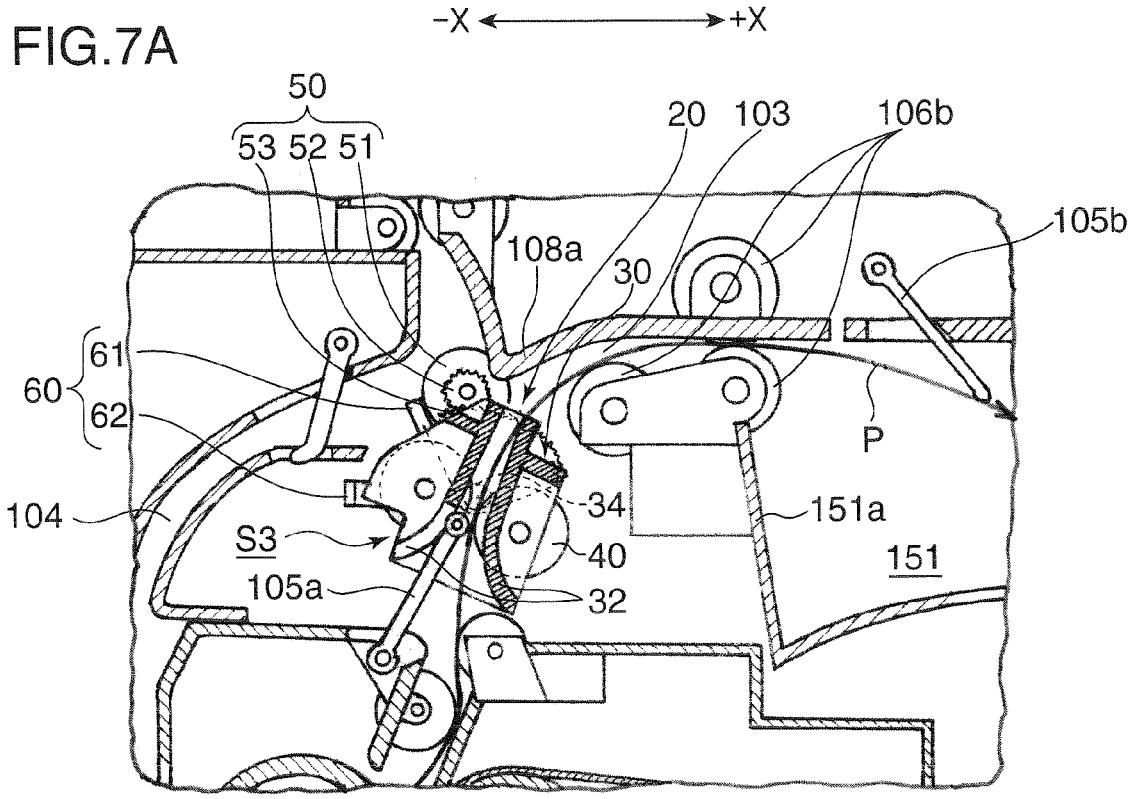
FIG. 7A shows a state that the rotary guide member is set to an internal discharge tray oriented posture.
Figure 7B:
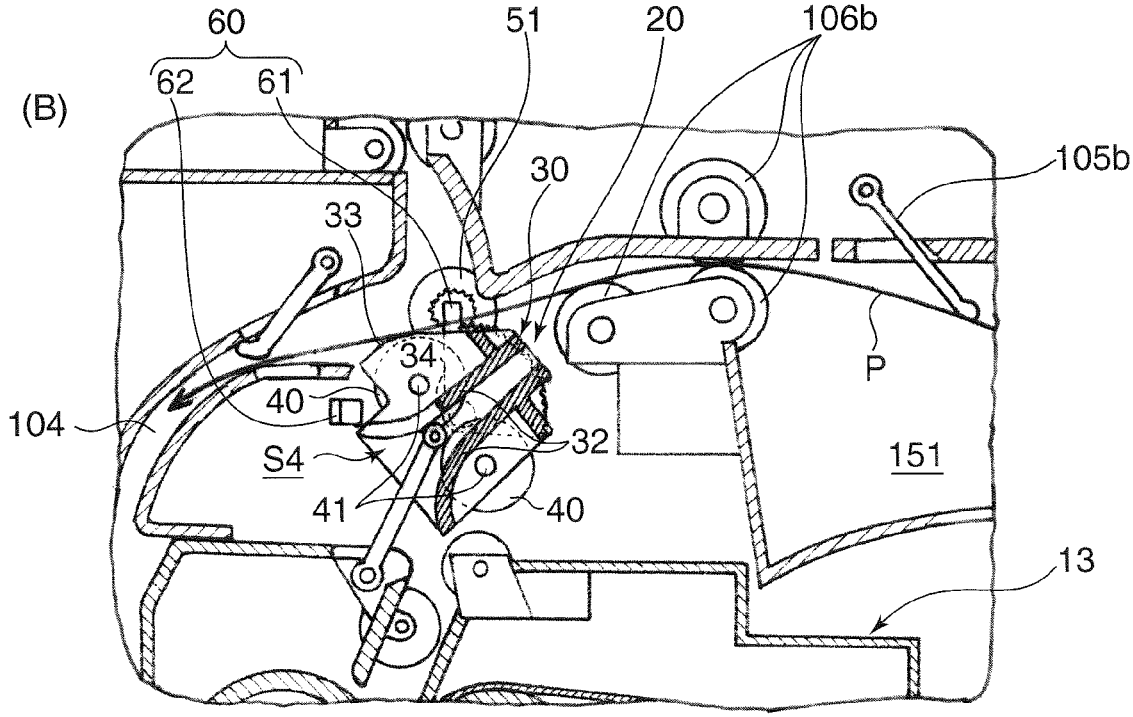

In the following, sheet guide postures of the rotary guide member 30 are described referring to FIGS. 6A through 7B. FIGS. 6A through 7B are front sectional views of the rotary guide member 30 for describing sheet guide postures of the rotary guide member 30. FIG. 6A shows a state that the rotary guide member 30 is set to the reference posture S1, and FIG. 6B shows a state that the rotary guide member 30 is set to the upright posture S2. FIG. 7A shows a state that the rotary guide member 30 is set to an internal discharge tray oriented posture S3, and FIG. 7B shows a state that the rotary guide member 30 is set to the inversion path oriented posture S4. The direction indications with the symbol "X" in FIGS. 6A through 7B are the same as those in FIG. 1, wherein −X direction is called a leftward direction, and +X direction is called as a rightward direction.

As shown in FIG. 6A, when the rotary guide member 30 is set to the reference posture S1, the rotary guide member 30 is pivotally moved counterclockwise about the axes of the guide shafts 34 to such a position that the guide passage 320 is displaced with respect to a vertical position by about 30°. Thereby, the rotary guide member 30 is inclined in leftward direction. In this state, the light blocking member 61 fixed to the section gear 53 is interposed between the paired element support arms 622 of the light sensor 62, thereby blocking light incidence from the light emitting element 623 (see FIG. 3) onto the light receiving element 624. Thereby, the reference position detector 60 is operable to detect that the rotary guide member 30 is set to the reference posture S1.

In the first embodiment, the rotary guide member 30 is set to the reference posture S1 in advance, as an initial posture, in starting a job of the image forming apparatus 10. The posture of the rotary guide member 30 is changed by the controlling device 54 depending on the kind of job to be designated by the user through the operating section 17.

Specifically, in the case where the user designates a sheet P to be discharged to the external tray 152 or the internal sheet finisher 153, a control signal from the controlling device 54 is outputted to the stepping motor 51. The control signal is a control signal containing pulses of a number required for pivotally moving the rotary guide member 30 from the reference posture S1 to the upright posture S2.

Thereby, the stepping motor 51 is rotatably driven by the angle corresponding to the pulse number. The driving force of the stepping motor 51 is transmitted to the rotary guide member 30 via the drive shaft 511, the drive gear 52, and the section gear 53. Thereby, the rotary guide member 30 is pivotally moved clockwise about the axes of the guide shafts 34 by a predetermined angle from the reference posture S1 to the upright posture S2, as shown in FIG. 6B.

When the rotary guide member 30 is set to the upright posture S2, a sheet P transported from the fixing section 13 is guided into the guide passage 320 of the rotary guide member 30 through the receiving opening 321 via the internal guide sensor 105*a*, and discharged toward the upper end transport path 101*a* defined above the rotary guide member 30 through the discharge port 351 along a clearance between the paired guide pulleys 40. Thereafter, the sheet P is directly discharged onto the external tray 152; or discharged onto the external tray 152 as a sheet bundle, after temporary discharge to the internal sheet finisher 153 for a post-processing operation such as stapling, by an operation of the switching guide member 107. After the designated job is ended, the rotary guide member 30 is returned to the reference posture S1.

In the case where the user inputs an operation signal to discharge a sheet P onto the internal discharge tray 151 through the operating section 17, the controlling device 54 outputs, to the stepping motor 51, a control signal containing pulses of a number required for pivotally moving the rotary guide member 30 from the reference posture S1 to the internal discharge tray oriented posture S3.

Then, the stepping motor 51 is rotatably driven by the angle corresponding to the pulse number. Thereby, the rotary guide member 30 is pivotally moved clockwise about the axes of the guide shafts 34 by a predetermined angle from the reference posture S1 to the internal discharge tray oriented posture S3. Thereby, as shown in FIG. 7A, the rotary guide member 30 is set to the internal discharge tray oriented posture S3.

When the rotary guide member 30 is set to the internal discharge tray oriented posture S3, a sheet P transported from the fixing section 13 is guided into the guide passage 320 of the rotary guide member 30, exits the discharge port 351, and is discharged to the internal discharge tray 151 while being guided by the first arc guide plate 108*a*.

In the case where the user designates a double-side printing operation through the operating section 17, the internal discharge tray 151 serves as a switchback tray. Specifically, the rotary guide member 30 is temporarily set to the internal discharge tray oriented posture S3, as shown in FIG. 7A, for temporarily discharging a sheet P subjected to a one-side printing operation onto the internal discharge tray 151.

After the temporary discharge of the sheet P onto the internal discharge tray 151 is detected by the first discharge sensor 105*b*, the posture of the rotary guide member 30 is changed from the internal discharge tray oriented posture S3 to the inversion path oriented posture S4, as shown in FIG. 7B. After the rotary guide member 30 is set to the inversion path oriented posture S4, driving rotation of the first discharge roller pair 106*b* in forward direction continues to discharge the sheet P to the internal discharge tray 151 until a downstream end of the sheet P exits the guide passage 320 of the rotary guide member 30. The first discharge roller pair 106*b* is then driven to rotate in backward direction after the downstream end of the sheet P has exited the guide passage 320, and before the downstream end of the sheet P reaches the first discharge roller pair 106*b*.

The backward rotation of the first discharge roller pair 106*b* allows for feeding the sheet P in backward direction immediately before the sheet P is completely discharged onto the internal discharge tray 151. The sheet P is then returned to the image forming section 12 via the transport path defined by the guide fins 33 of the rotary guide member 30 and the second arc guide plate 108*b*, and the inversion path 104. Thereafter, the sheet P is subjected to a printing operation of printing an image on the other side of the sheet P.

In performing a switchback operation of a sheet P transported from the fixing section 13 as described above, after the rotary guide member 30 is moved from the reference posture S1 to the internal discharge tray oriented posture S3, the rotary guide member 30 is sequentially and directly moved from the internal discharge tray oriented posture S3 to the inversion transport path oriented posture S4, without returning to the reference posture S1.

As described above in detail, the sheet transport direction switching device 20 of the first embodiment includes: the rotary guide member 30 provided with the single guide passage 320 for passing a sheet P, and operable to change the posture thereof by pivotal movement about the axes of the guide shafts 34 so that the discharge port 351 of the guide passage 320 faces one of at least two discharge destinations (in this embodiment, the internal discharge tray 151 and the external tray 152); and the posture changing mechanism 50 for changing the posture of the rotary guide member 30. The posture changing mechanism 50 has the stepping motor 51 for pivotally moving the rotary guide member 30 in forward or backward direction about the axes of the guide shafts 34.

In the sheet transport direction switching device 20 having the above arrangement, the posture changing mechanism 50 has the stepping motor 51 operable to be accurately and rotatably driven depending on the number of pulses in a pulse signal. Accordingly, an operation of switching a sheet discharge destination is precisely performed by the rotary guide member 30. Also, the rotary guide member 30 has the single guide passage 320. Accordingly, unlike a conventional rotary guide member having multiple guide passages, the above arrangement reduces the number of parts, because a large number of parts is not necessary. Thus, the arrangement of the embodiment contributes to reduction of the production cost of the sheet transport direction switching device 20.

The guide pulleys 40 are provided in the guide passage 320. Accordingly, a sheet P guided into the guide passage 320 is transported by free rotation of the guide pulleys 40 i.e. contact with the surfaces of the guide pulleys 40, without a likelihood that an image forming surface of the sheet P may be contacted with an inner wall of the guide passage 320 (i.e. the surface of the corresponding arc guide plate 32) while the sheet P is guided in the guide passage 320. This prevents an improper image formation by contact of an effective area of a sheet P carrying a toner image with the inner wall of the guide passage 320.

In this embodiment, the internal discharge tray 151 serves as a switchback tray for temporarily discharging a sheet P so as to inverse the transport direction of the sheet P for a double-side printing operation. This arrangement contributes to reduction of the production cost, as compared with an arrangement that a dedicated switchback tray is provided.

Second Embodiment

In the second embodiment, a control operation of stabilizing a transport operation of a sheet P in the case where the sheet P is about to enter a guide passage 320 of a rotary guide member 30 is described. Since the arrangement of an image forming apparatus 10 to which the second embodiment is applied is substantially the same as the arrangement of the image forming apparatus of the first embodiment described referring to FIGS. 1 through 5, description thereof is omitted herein.

FIGS. 8 through 12 are diagrams for describing sheet guide postures of the rotary guide member 30 in the second embodiment. In the second embodiment, a controlling device 54 (see FIG. 3) controls a stepping motor 51 so that the rotary guide member 30 is set to a receiving posture when the sheet P is about to enter the entrance (see the receiving opening 321 in FIG. 5) of the guide passage 320, without depending on the discharge destination of the sheet P. The receiving posture is a posture for allowing entry of a lead end of a sheet P to be transported from a fixing section 13 into the receiving opening 321 at a substantially middle position in leftward and rightward directions, and guiding the sheet P into the guide passage 320 without obstruction.

Figure 8:
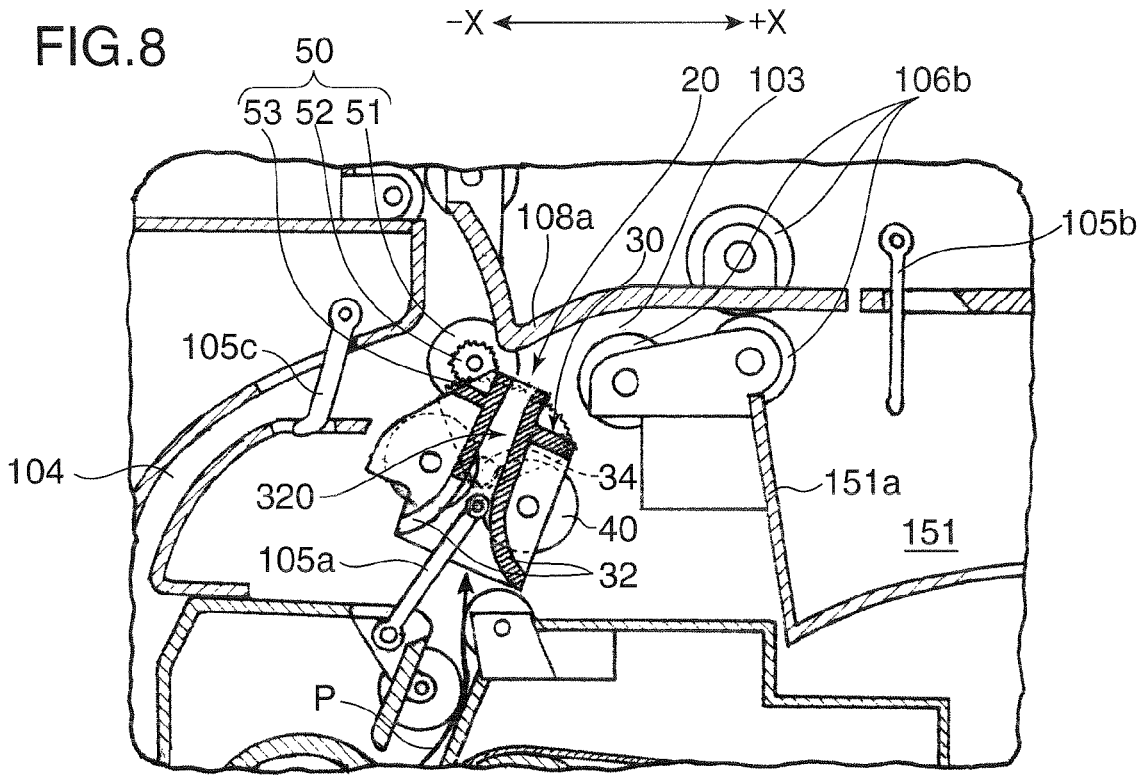
FIG. 8 is a diagram for describing a sheet guide posture of a rotary guide member as a second embodiment, specifically, showing a state that the rotary guide member is set to a receiving posture.

FIG. 8 is a diagram showing a state that the rotary guide member 30 is set to the receiving posture i.e. a state immediately before a sheet P is about to enter the rotary guide member 30. The controlling device 54 is operable to temporarily set the rotary guide member 30 to the receiving posture when the sheet P is about to enter the rotary guide member 30, without depending on the discharge destination of the sheet P i.e. an internal discharge tray 151, an external tray 152, or an internal sheet finisher 153. When the rotary guide member 30 is set to the receiving posture, the receiving opening 321 faces the transport path of the sheet P in forward direction. Specifically, even if a lead end of a sheet P is curled, the sheet P is securely allowed to enter the guide passage 320 through the receiving opening 321. This stabilizes the transport operation of a sheet P, and suppresses transport failure such as a jam of a sheet P, or a crease in a corner of a lead portion of a sheet P.

Figure 9:
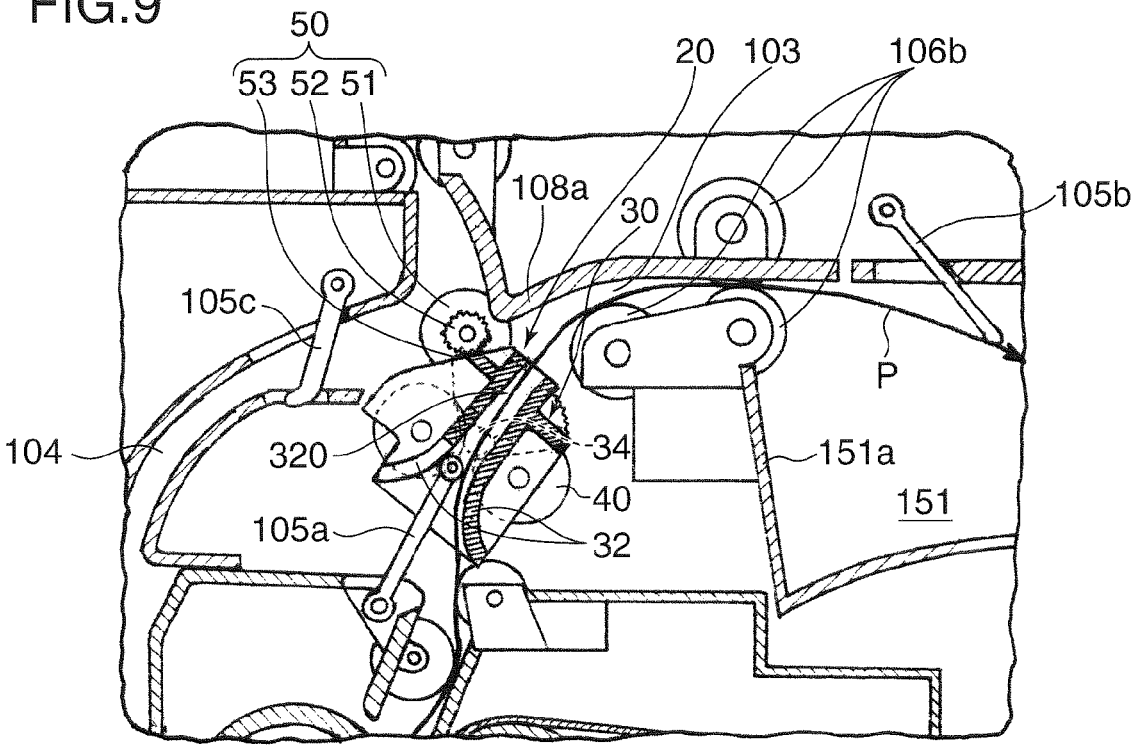
FIG. 9 is a diagram showing a posture of the rotary guide member in discharging a sheet to an internal discharge tray.

FIG. 9 is a diagram showing a discharging posture of the rotary guide member 30 in discharging a sheet P to the internal discharge tray 151. When the rotary guide member 30 is set to the discharging posture as shown in FIG. 9, the rotary guide member 30 is slightly inclined clockwise with respect to the receiving posture as shown in FIG. 8. The controlling device 54 controls the stepping motor 51 to pivotally move the rotary guide member 30 to the discharging posture as shown in FIG. 9, in the case where the internal discharge tray 151 is selected as the discharge destination of a sheet P, and an internal guide sensor 105*a* (first sensor) detects that the sheet P has entered the guide passage 320.

By performing the above operation, the exit (see the discharge opening 322 in FIG. 5) of the guide passage 320 faces a switchback path 103 in substantially forward direction, before the lead end of the sheet P is discharged from the rotary guide member 30 through the discharge opening 322. When the rotary guide member 30 is set to the discharging posture as shown in FIG. 9, the approach angle of the sheet P to be discharged from the rotary guide member 30 with respect to the switchback path 103 (first arc guide plate 108*a*) is reduced. This arrangement securely suppresses transport failure of a sheet P.

Alternatively, the receiving posture and the discharging posture for discharging a sheet P to the internal discharge tray 151 may be identical to each other. In other words, the receiving posture as shown in FIG. 8 may be used as the discharging posture as shown in FIG. 9. In this modification, in the case where the internal discharge tray 151 is selected as the discharge destination of a sheet P, the rotary guide member 30 is unmoved. Thereby, the modification reduces the number of operations of pivotally moving the rotary guide member 30.

Figure 10:
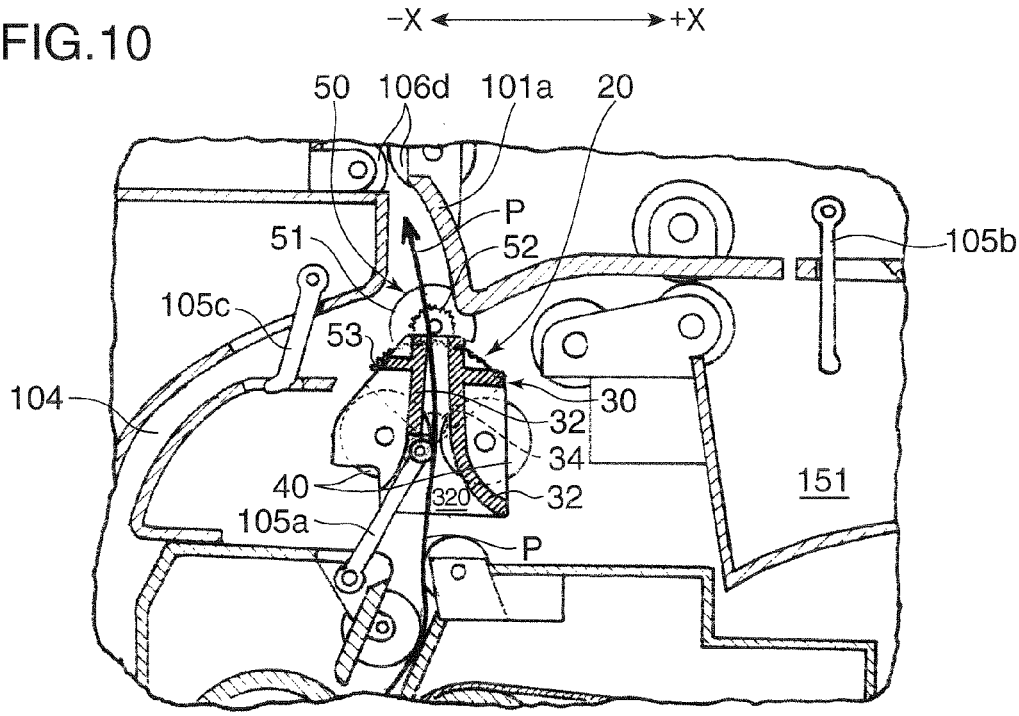
FIG. 10 is a diagram showing a posture of the rotary guide member in discharging a sheet to an external tray.

FIG. 10 is a diagram showing a posture of the rotary guide member 30 in discharging a sheet P to the external tray 152 or the internal sheet finisher 153. The controlling device 54 is operable to change the posture of the rotary guide member 30 from the receiving posture as shown in FIG. 8 to an upright posture i.e. the discharging posture as shown in FIG. 10, in the case where the external tray 152 is selected as the discharge destination of a sheet P, and the internal guide sensor 105*a* detects that the sheet P has entered the guide passage 320. Thereby, the discharge opening 322 faces an upper end transport path 101*a* communicating with a sheet discharge path 102, before the lead end of the sheet P is discharged through the discharge opening 322. This arrangement smoothly guides the sheet P to the upper end transport path 101*a*.

Figure 11:
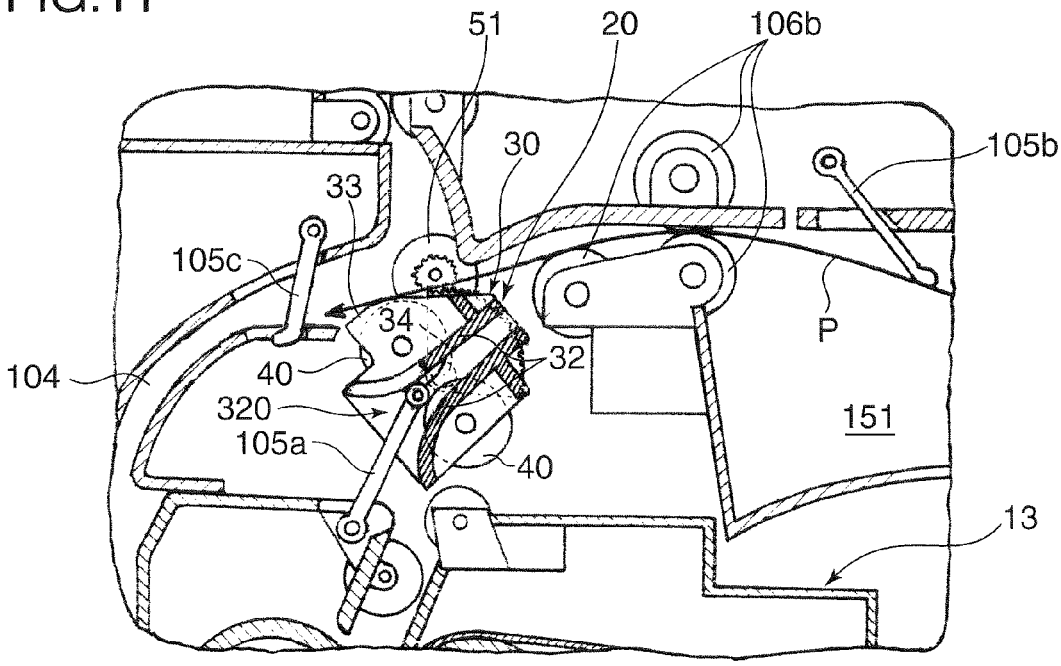
FIG. 11 is a diagram showing a posture of the rotary guide member in guiding a sheet to an inversion path.

FIG. 11 is a diagram showing a guiding posture of the rotary guide member 30 in the case where a sheet P is guided to an inversion path 104. The guiding posture as shown in FIG. 11 is identical to the posture S4 as shown in FIG. 7B. When the rotary guide member 30 is set to the guiding posture as shown in FIG. 11, the rotary guide member 30 is inclined clockwise with respect to the discharging posture as shown in FIG. 9 so that guide fins 33 are allowed to guide the sheet P to the inversion path 104. The rotary guide member 30 is held at the guiding posture as shown in FIG. 11 until an inversion sensor (second sensor) 105*c* detects the lead end of the sheet P. After the detection, the rotary guide member 30 is set to the receiving posture.

Figure 12:
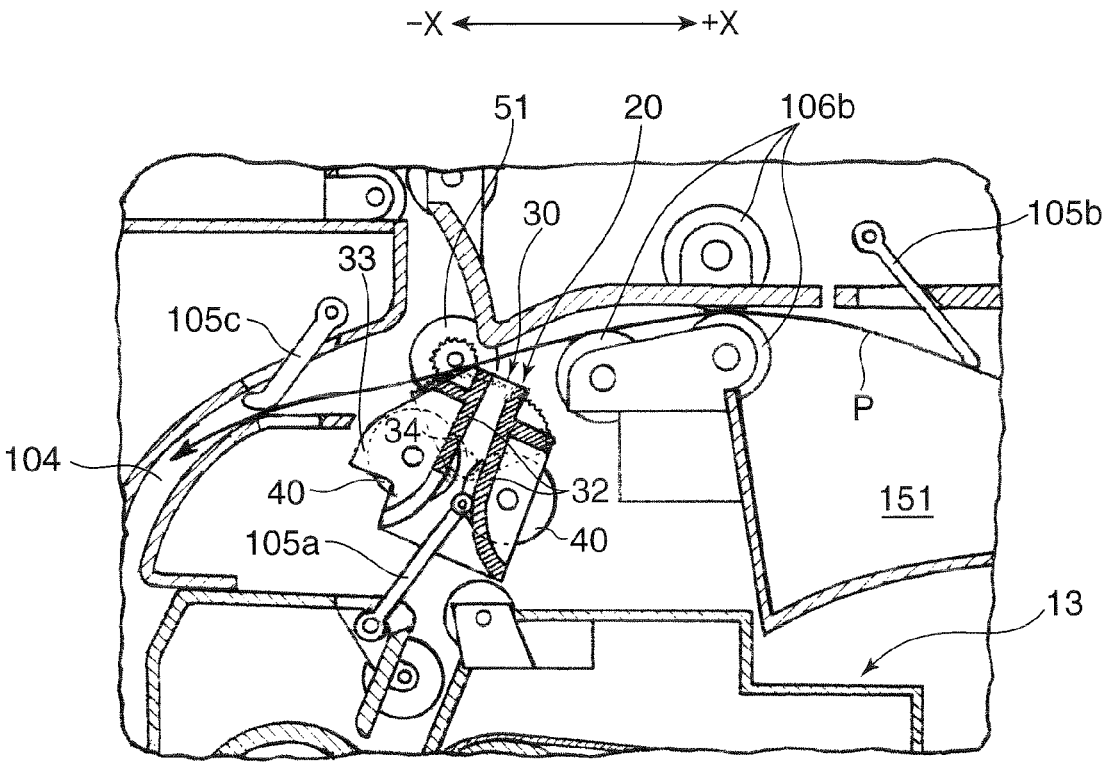
FIG. 12 is a diagram showing a state that the rotary guide member is set to the receiving posture, while guiding a sheet to the inversion path.

FIG. 12 is a diagram showing a state that the rotary guide member 30 is set to the receiving posture, while guiding a sheet P to the inversion path 104. The controlling device 54 is operable to change the posture of the rotary guide member 30 from the guiding posture as shown in FIG. 11 to the receiving posture as shown in FIG. 12, in the case where a double-side printing operation is selected, and the inversion sensor 105*c* detects that the lead end of the sheet P has entered the inversion path 104. The receiving posture as shown in FIG. 12 is identical to the receiving posture as shown in FIG. 8. Even if the rotary guide member 30 is set to the receiving posture as shown in FIG. 12, parts of the guide fins 33 are allowed to guide the sheet P.

As described above, changing the posture of the rotary guide member 30 to the receiving posture while a preceding sheet P is guided in the inversion path 104 allows for entry of a succeeding sheet P to the guide passage 320 of the rotary guide member 30. This increases the double-side printing speed of the image forming apparatus 10.

Figure 13:
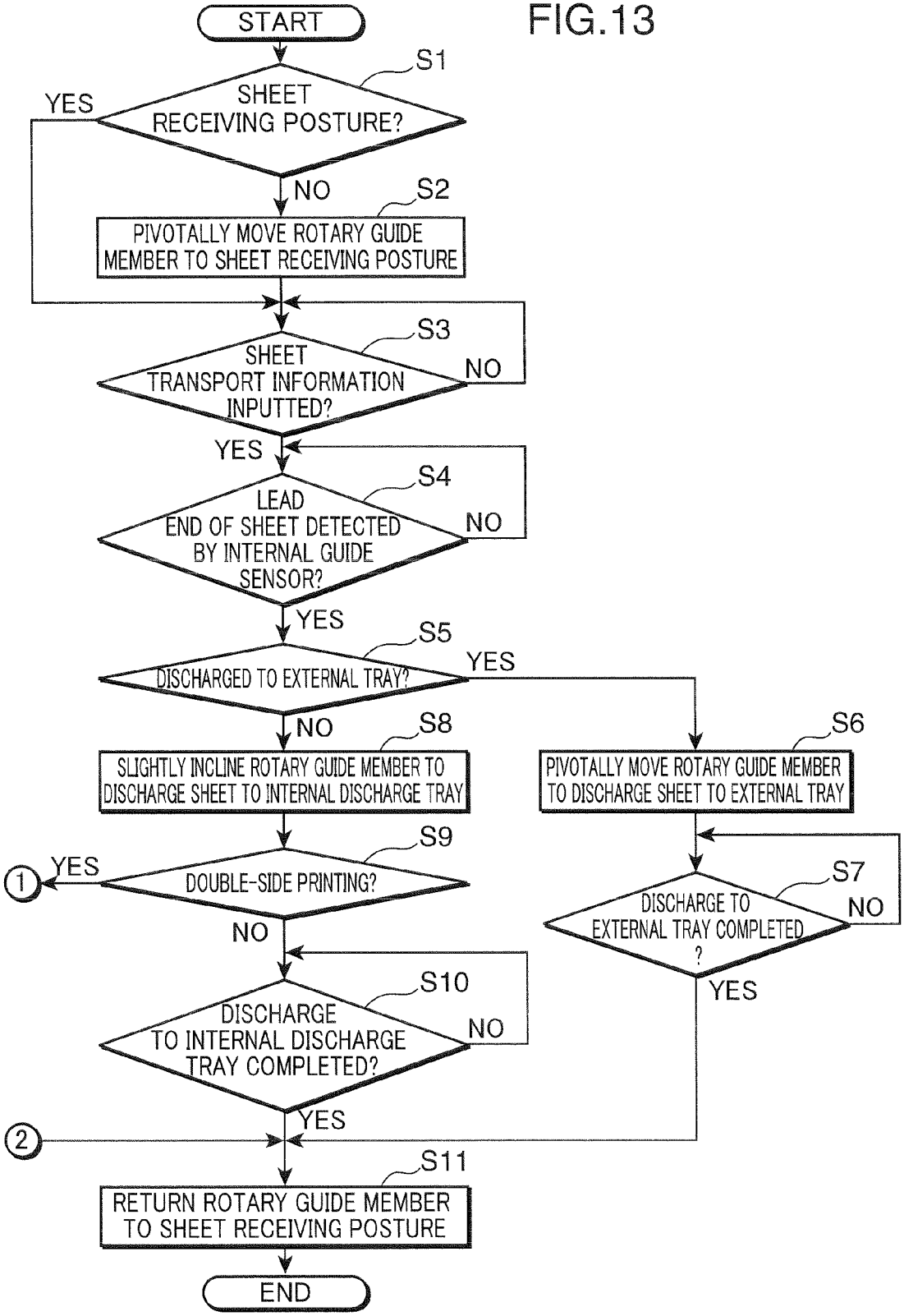
FIGS. 13 and 14 are flowcharts for describing an operation of the rotary guide member to be controlled by a controlling device.

FIG. 13 is a flowchart for describing an operation of the rotary guide member 30 to be controlled by the controlling device 54 in the second embodiment. The controlling device 54 checks whether the rotary guide member 30 is in the receiving posture as shown in FIG. 8, as an initial condition, upon supply of electric power to the image forming apparatus 10 (Step S1). If it is judged that the rotary guide member 30 is not in the receiving posture (NO in Step S1), the controlling device 54 controls the stepping motor 51 to pivotally move the rotary guide member 30 to the receiving posture (Step S2). If it is judged that the rotary guide member 30 is in the receiving posture (YES in Step S1), the routine skips Step S2.

Then, the controlling device 54 checks whether information relating to transport of a sheet P has been inputted, in other words, whether an image forming operation is executed by the image forming section 12 (Step S3). If it is judged that no sheet transport information has been inputted (NO in Step S3), the routine waits. If it is judged that sheet transport information has been inputted (YES in Step S3), the internal guide sensor 105*a* checks whether the lead end of a sheet P has been detected (Step S4).

If it is judged that the internal guide sensor 105*a* has detected the lead end of a sheet P (YES in Step S4), the controlling device 54 checks whether the discharge destination of the sheet P is the external tray 152 (Step S5). In this example, a case of transporting a sheet P to the internal sheet finisher 153 is omitted. If it is judged that the discharge destination of the sheet P is the external tray 152 (YES in Step S5), the controlling device 54 controls the rotary guide member 30 to change the posture of the rotary guide member 30 to the upright posture as shown in FIG. 10 (Step S6). Specifically, the controlling device 54 outputs, to the stepping motor 51, a drive pulse necessary for pivotally moving the rotary guide member 30 from the receiving posture to the upright posture.

Thereafter, the controlling device 54 checks whether the sheet P has been discharged to the external tray 152 (Step S7). The check may be made based on e.g. a judgment as to whether the second discharge sensor 105*d* has detected the trail end of the sheet P in the transport direction. If it is judged that the sheet P has been discharged to the external tray 152 (YES in Step S7), the controlling device 54 controls the rotary guide member 30 to move the rotary guide member 30 to the receiving posture (Step S11). In this way, a transport operation of one sheet P is completed. In the case where a succeeding sheet is to be transported, the routine returns to Step S4, and repeats the aforementioned operations.

If it is judged that the discharge destination of the sheet P is not the external tray 152 (NO in Step S5), the controlling device 54 controls the rotary guide member 30 so that the rotary guide member 30 is slightly inclined clockwise with respect to the receiving posture to the discharging posture for discharging a sheet P to the internal discharge tray 151, as shown in FIG. 9 (Step S8). Then, the controlling device 54 checks whether a double-side printing operation has been designated (Step S9).

If it is judged that a double-side printing operation has not been designated (NO in Step S9), it is checked whether discharge of the sheet P to the internal discharge tray 151 has been completed (Step S10). The check may be made based on e.g. a judgment as to whether the first discharge sensor 105*b* has detected the trail end of the sheet P in the transport direction. If it is judged that the sheet P has been discharged to the internal discharge tray 151 (YES in Step S10), the controlling device 54 controls the rotary guide member 30 to move the rotary guide member 30 to the receiving posture (Step S11).

Figure 14:
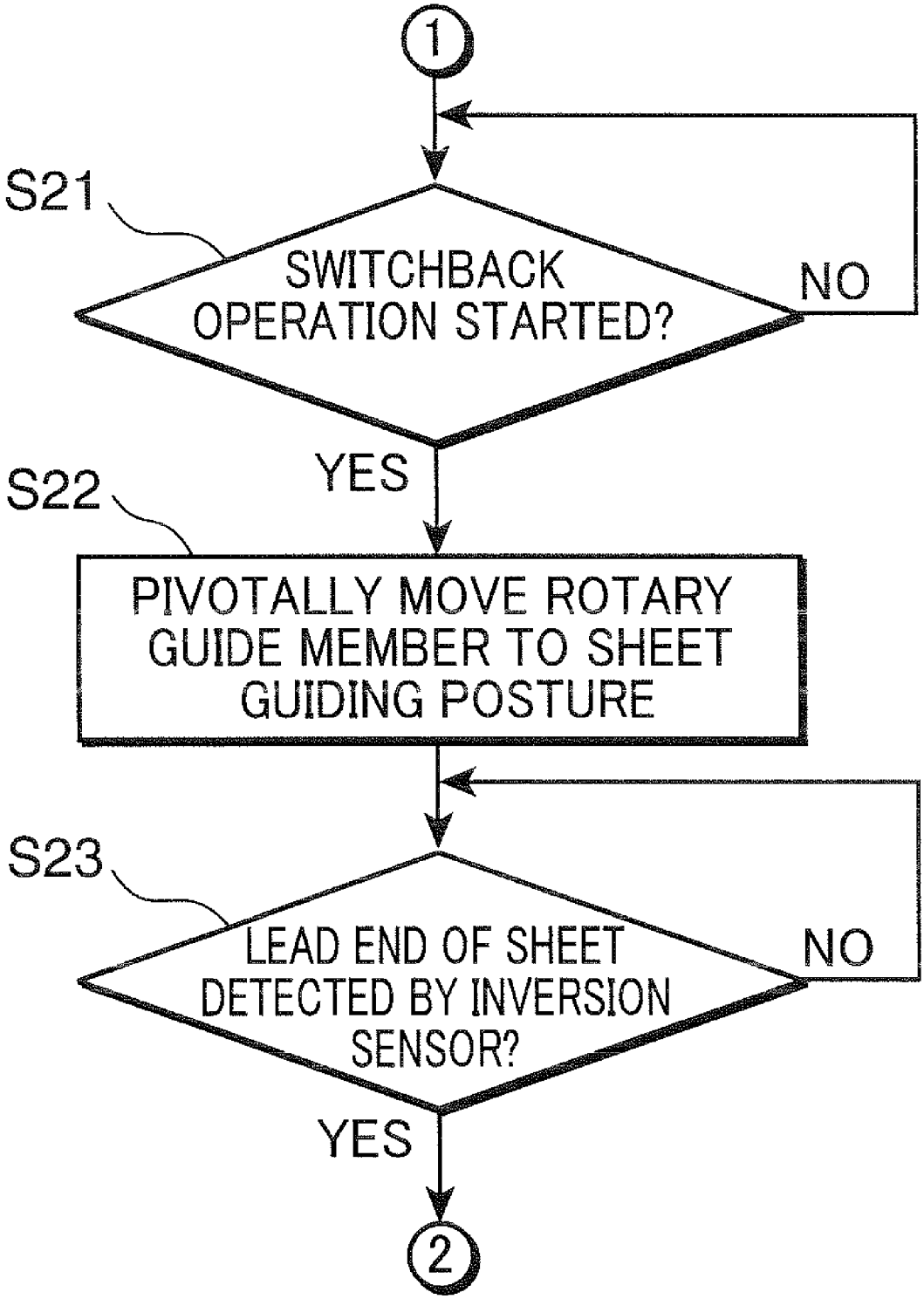

If it is judged that a double-side printing operation has been designated (YES in Step S9), the routine proceeds to the flowchart shown in FIG. 14. Then, the controlling device 54 checks whether a switchback operation of the sheet P using the internal discharge tray 151 has been started (Step S21). The check may be made based on a judgment as to whether a signal indicating backward rotation of a first discharge roller pair 106*b* for a switchback operation has been issued to an unillustrated motor for driving the first discharge roller pair 106*b*.

If it is judged that a switchback operation has been started (YES in Step S21), the controlling device 54 controls the rotary guide member 30 to pivotally move the rotary guide member 30 clockwise to the guiding posture, as shown in FIG. 11, so that the guide fins 33 guide the sheet P to the inversion path 104 (Step S22). Then, it is checked whether the inversion sensor 105*c* has detected the lead end of the sheet P in the inversion path 104 (Step S23). If it is judged that the inversion sensor 105*c* has outputted a signal indicating detection of the lead end of the sheet P (YES in Step S23), the controlling device 54 controls the rotary guide member 30 to pivotally move the rotary guide member 30 counterclockwise to the receiving posture for receiving a succeeding sheet P (Step S11).

In the second embodiment having the above arrangement, the rotary guide member 30 is temporarily set to the receiving posture, without depending on the discharge destination of a sheet P. Accordingly, a transport operation of a sheet P in entering the guide passage 320 can be stabilized. This suppresses transport failure such as a jam of a sheet P, or a crease in a corner of a lead portion of a sheet P. Also, after the sheet P has entered the rotary guide member 30, the rotary guide member 30 is pivotally moved to such a position that the exit of the guide passage 320 faces the transport path to the internal discharge tray 151 or the transport path to the external tray 152. This prevents transport failure of a sheet P. Further, in a double-side printing operation, the rotary guide member 30 is set to the receiving posture immediately after the lead end of the sheet P has entered the inversion path 104. This improves the operation efficiency of the double-side printing operation.

(Modifications)

The invention is not limited to the first and the second embodiments, but may embrace the following modifications.

(1) In the foregoing embodiments, the sheet transport direction switching device 20 is applied to the image forming apparatus 10. The sheet transport direction switching device 20 may be applied to various apparatuses for handling a sheet, other than the image forming apparatus 10. The sheet transport direction switching device 20 may also be applied to a post-processing device, communicated with a downstream portion of the image forming apparatus 10, for applying a post-processing operation such as stapling for discharged sheets.

(2) In the foregoing embodiments, a copying machine is described as an example of the image forming apparatus 10.

Alternatively, the image forming apparatus 10 may be a printer or a facsimile machine.

(3) In the foregoing embodiments, a plain sheet is described as an example of the sheet. Alternatively, the sheet may be thick paper having a large resilience, or a transparent film of a synthetic resin for use in an overhead projector, in addition to the plain sheet.

(4) In the foregoing embodiments, in the case where a double-side printing operation is performed, a sheet P subjected to a one-side printing operation is temporarily guided to the internal discharge tray 151, where the sheet P is subjected to a switchback operation to transport the sheet P in backward direction. Alternatively, a sheet P may be temporarily guided to the internal sheet finisher 153. Further alternatively, a temporary discharge space for a switchback operation may be defined, in place of using the internal discharge tray 151 or the internal sheet finisher 153 as a switchback tray.

The foregoing embodiments mainly embrace the inventions having the following arrangements.

A sheet transport direction switching device according to an aspect of the invention includes: a rotary guide member including a single guide passage for passing a sheet to be transported, and a support shaft extending in a direction orthogonal to a transport direction of the sheet, the rotary guide member being operable to change a posture thereof by pivotal movement about an axis of the support shaft so that an exit of the guide passage faces one of at least two discharge destinations; and a posture changing mechanism for changing the posture of the rotary guide member, wherein the posture changing mechanism has a stepping motor for pivotally moving the rotary guide member about the axis of the support shaft.

In the above arrangement, the posture changing mechanism has the stepping motor operable to be accurately and rotatably driven depending on the number of pulses in a pulse signal. Accordingly, an operation of switching the discharge destination of a sheet can be precisely performed by the rotary guide member. Also, the rotary guide member has the single guide passage. Accordingly, unlike a conventional complicated-structured rotary guide member incorporated with many parts and having multiple guide passages, the above arrangement reduces the number of parts, thereby reducing the parts cost.

Preferably, the sheet transport direction switching device may further include a guide pulley operable to freely rotate about an axis parallel to the axis of the support shaft, apart of the guide pulley projecting in the guide passage. This arrangement allows for smooth passing of a sheet in the guide passage by the guide pulley.

In the above arrangement, preferably, the guide pulley may be provided in a pair, and the parts of the paired guide pulleys may project in the guide passage in a state that surfaces of the paired guide pulleys oppose to each other.

In the above arrangement, a sheet guided into the guide passage of the rotary guide member is transported by free rotation of the guide pulleys i.e. contact with the surfaces of the guide pulleys, without a likelihood that an image forming surface of the sheet may be contacted with an inner wall of the guide passage while the sheet is guided in the guide passage. This prevents an improper image formation, without a likelihood that the image forming surface of the sheet may be contacted with the inner wall of the guide passage.

In the above arrangement, preferably, the single guide passage may be defined by a pair of guide plates disposed opposite to each other with a certain clearance, and an opening at one ends of the paired guide plates may be defined as an entrance of the guide passage, and an opening at the other ends thereof may be defined as the exit of the guide passage. In this arrangement, a guide passage provided with an entrance and an exit is easily defined.

In the above arrangement, preferably, at least one of the paired guide plates may have an arc surface extending in a direction of the guide passage, and the size of the opening at the entrance of the guide passage may be larger than the size of the opening at the exit of the guide passage by the arc surface. This arrangement allows for smooth entry of a sheet into the guide passage through the entrance.

Preferably, the sheet transport direction switching device may further include a controlling device for controlling an operation of the stepping motor, wherein the rotary guide member is movable to a receiving posture where the entrance of the guide passage is aligned in a predetermined direction, and the controlling device controls the stepping motor to move the rotary guide member to the receiving posture until the sheet is allowed to enter the entrance of the guide passage in the case where the sheet is guided in a state that the exit of the guide passage of the rotary guide member faces one of the at least two discharge destinations.

In the above arrangement, a sheet is allowed to enter the guide passage of the rotary guide member in the receiving posture, without depending on the discharge destination of the sheet. This stabilizes a transport operation of a sheet in entering the guide passage, and suppresses transport failure such as a jam of a sheet, or a crease in a corner end of a sheet.

In the above arrangement, preferably, the receiving posture of the rotary guide member may be substantially identical to a posture of the rotary guide member where the exit of the guide passage faces one of the at least two discharge destinations. This arrangement maximally suppresses a movement of the rotary guide member for changing a posture thereof.

Preferably, the sheet transport direction switching device may further include a first sensor, disposed in the guide passage of the rotary guide member, for detecting whether the sheet has entered the guide passage, wherein the controlling device is operable to change the posture of the rotary guide member from the receiving posture to a posture where the exit of the guide passage faces one of the at least two discharge destinations, in the case where a lead end of the sheet is detected by the first sensor. This arrangement securely changes the posture of the rotary guide member, after the sheet has entered the guide passage.

An image forming apparatus according to another aspect of the invention includes: an image forming section for forming an image on a sheet; a main transport path for transporting the sheet via the image forming section; at least two sub transport paths defined at a downstream side of the main transport path; and a sheet transport direction switching device, disposed between the main transport path and the sub transport paths, for switching a transport direction of the sheet between the at least two sub transport paths, as discharge destinations. The sheet transport direction switching device includes a rotary guide member having a single guide passage for passing the sheet to be transported, and a support shaft extending in a direction orthogonal to the sheet transport direction, the rotary guide member being operable to change a posture thereof by pivotal movement about an axis of the support shaft so that an exit of the guide passage faces one of the at least two sub transport paths, and a posture changing mechanism having a stepping motor for pivotally moving the rotary guide member about the axis of the support shaft, and operable to change the posture of the rotary guide member.

The image forming apparatus having the above arrangement is operable to easily and properly switch the discharge destination of a sheet from the main transport path between the at least two sub transport paths by an operation of the sheet transport direction switching device.

Preferably, the image forming apparatus may further include: a first discharge tray as a first discharge destination of the sheet; and a second discharge tray as a second discharge destination different from the first discharge destination, wherein the sub transport paths include a first sub transport path for transporting the sheet to the first discharge tray, and a second sub transport path for transporting the sheet to the second discharge tray. In this arrangement, a sheet is accurately discharged to the first discharge tray or the second discharge tray.

Preferably, the image forming apparatus may further include: an inversion path for transporting the sheet in a backward direction to an upstream side of the main transport path with respect to the image forming section to perform a double-side printing operation; and a switchback section, disposed at a downstream side of the sheet transport direction switching device, for subjecting the sheet to a switchback operation to transport the sheet to the inversion path, wherein the sub transport paths include a third sub transport path for transporting the sheet to the switchback section. In this arrangement, a sheet is accurately transported to the inversion path for a double-side printing operation, as well as the first discharge tray and the second discharge tray.

In the above arrangement, preferably, the image forming apparatus may be of an internal discharge type, the first discharge tray may be an internal discharge tray, the image forming apparatus may further include a roller pair, disposed in the first sub transport path, for imparting a force to transport the sheet, and the roller pair may be driven to rotate in a forward direction to transport the sheet to the internal discharge tray, and driven to rotate in a backward direction to transport the sheet to the inversion path. In this arrangement, the roller pair and the internal discharge tray function as the switchback section. Accordingly, the number of parts is reduced, because there is no need of providing a dedicated switchback section. Thus, the arrangement contributes to reduction of the production cost of the image forming apparatus.

Preferably, the image forming apparatus may further include a controlling device for controlling an operation of the stepping motor. The rotary guide member may be so constructed that: the single guide passage is defined by a pair of guide plates disposed opposite to each other with a certain clearance, an opening at one ends of the paired guide plates being defined as an entrance of the guide passage, and an opening at the other ends thereof being defined as an exit of the guide passage; at least one of the paired guide plates has a surface for defining the guide passage on the other side thereof, and a guide surface thereof for guiding the sheet; and the rotary guide member is movable to a receiving posture where the entrance of the guide passage is aligned in a predetermined direction. The controlling device may control the stepping motor to: move the rotary guide member to the receiving posture until the sheet is allowed to enter the entrance of the guide passage, in the case where the sheet is guided in a state that the exit of the guide passage faces one of the first sub transport path and the second sub transport path; and move the rotary guide member to a guiding posture for guiding the sheet along the guide surface, in the case where the sheet is transported to the inversion path.

In the above arrangement, a sheet being transported to the inversion path is guided by using a portion of the rotary guide member other than the guide passage.

Preferably, the image forming apparatus may further include a second sensor, disposed in the inversion path, for detecting whether the sheet has entered the inversion path, wherein the controlling device is operable to change the posture of the rotary guide member from the guiding posture to the receiving posture, in the case where a lead end of the sheet is detected by the second sensor.

In the above arrangement, a succeeding sheet is allowed to enter the guide passage of the rotary guide member, while a preceding sheet is guided in the guide passage. This improves the operation speed of the image forming apparatus.

Preferably, the image forming apparatus may further include a controlling device for controlling an operation of the stepping motor, wherein the rotary guide member is movable to a receiving posture where an entrance of the guide passage is aligned in a predetermined direction, and the controlling device controls the stepping motor to move the rotary guide member to the receiving posture until the sheet is allowed to enter the entrance of the guide passage, in the case where the sheet is guided in a state that the exit of the guide passage faces one of the at least two sub transport paths.

In the above arrangement, a sheet is allowed to enter the guide passage of the rotary guide member in the receiving posture, without depending on the discharge destination of a sheet. This stabilizes a transport operation of a sheet in entering the guide passage, and suppresses transport failure such as a jam of a sheet, or a crease in a corner end of a sheet.

The invention having the above arrangements provides a sheet transport direction switching device operable to accurately switch the discharge destination of a sheet, without using a complicated-structured rotary guide member; and an image forming apparatus incorporated with the sheet transport direction switching device.

This application is based on Japanese Patent Application No. 2008-87388 filed on Mar. 28, 2008, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A sheet transport direction switching device comprising:

a rotary guide member including a single guide passage for passing a sheet to be transported, and a support shaft extending in a direction orthogonal to a transport direction of the sheet, the rotary guide member being operable to change a posture thereof by pivotal movement about an axis of the support shaft so that an exit of the guide passage faces one of at least two discharge destinations; and a posture changing mechanism for changing the posture of the rotary guide member, wherein the posture changing mechanism has a stepping motor for pivotally moving the rotary guide member about the axis of the support shaft; and at least one pair of guide pulleys operable to freely rotate about axes parallel to the axis of the support shaft, parts of the guide pulleys projecting in the guide passage in a state so that surfaces of the guide pulleys in the respective pair oppose each other, and the guide passage being narrowed between the surfaces of the guide pulleys in the respective pair of guide pulleys projecting in the guide passage.

2. The sheet transport direction switching device according to claim 1, wherein the single guide passage is defined by a pair of guide plates disposed opposite to each other with a certain clearance, and an opening at one ends of the paired guide plates is defined as an entrance of the guide passage, and an opening at the other ends thereof is defined as the exit of the guide passage.

3. The sheet transport direction switching device according to claim 2, wherein at least one of the paired guide plates has an arc surface extending in a direction of the guide passage, and the size of the opening at the entrance of the guide passage is larger than the size of the opening at the exit of the guide passage by the arc surface.

4. A sheet transport direction switching device comprising:

a rotary guide member including a single guide passage for passing a sheet to be transported, and a support shaft extending in a direction orthogonal to a transport direction of the sheet, the rotary guide member being operable to change a posture thereof by pivotal movement about an axis of the support shaft so that an exit of the guide passage faces one of at least two discharge destinations;

a posture changing mechanism for changing the posture of the rotary guide member, the posture changing mechanism having a stepping motor for pivotally moving the rotary guide member about the axis of the support shaft; and a controlling device for controlling an operation of the stepping motor, wherein the single guide passage is defined by a pair of guide plates disposed opposite to each other with a certain clearance, an opening at one end of the paired guide plates being defined as an entrance of the guide passage, and an opening at the other end thereof being defined as an exit of the guide passage;

the rotary guide member is movable to a receiving posture where the entrance of the guide passage is aligned in a predetermined direction, and the controlling device controls the stepping motor to move the rotary guide member to the receiving posture until the sheet is allowed to enter the entrance of the guide passage in the case where the sheet is guided in a state that the exit of the guide passage of the rotary guide member faces one of the at least two discharge destinations, so that the exit of the guide passage faces one of the at least two discharge destinations after the sheet is received in the entrance of the guide passage.

5. The sheet transport direction switching device according to claim 4, further comprising:

a guide pulley operable to freely rotate about an axis parallel to the axis of the support shaft, a part of the guide pulley projecting in the guide passage.

6. The sheet transport direction switching device according to claim 5, wherein the guide pulley is provided in a pair, and the parts of the paired guide pulleys project in the guide passage in a state that surfaces of the paired guide pulleys oppose to each other.

7. The sheet transport direction switching device according to claim 4, wherein the receiving posture of the rotary guide member is substantially identical to a posture of the rotary guide member where the exit of the guide passage faces one of the at least two discharge destinations.

8. A sheet transport direction switching device comprising:

a rotary guide member including a single guide passage for passing a sheet to be transported, and a support shaft extending in a direction orthogonal to a transport direction of the sheet, the rotary guide member being operable to change a posture thereof by pivotal movement about an axis of the support shaft so that an exit of the guide passage faces one of at least two discharge destinations;

a posture changing mechanism for changing the posture of the rotary guide member, the posture changing mechanism having a stepping motor for pivotally moving the rotary guide member about the axis of the support shaft;

a first sensor, disposed in the guide passage of the rotary guide member, for detecting whether the sheet has entered the guide passage; and a controlling device for controlling an operation of the stepping motor, wherein the single guide passage is defined by a pair of guide plates disposed opposite to each other with a certain clearance, an opening at one end of the paired guide plates being defined as an entrance of the guide passage, and an opening at the other end thereof being defined as the exit of the guide passage;

the rotary guide member is movable to a receiving posture where the entrance of the guide passage is aligned in a predetermined direction;

the controlling device controls the stepping motor to move the rotary guide member to the receiving posture until the sheet is allowed to enter the entrance of the guide passage in the case where the sheet is guided in a state that the exit of the guide passage of the rotary guide member faces one of the at least two discharge destinations to change the posture of the rotary guide member from the receiving posture to a posture where the exit of the guide passage faces one of the at least two discharge destinations, in the case where a lead end of the sheet is detected by the first sensor.

9. An image forming apparatus comprising:

an image forming section for forming an image on a sheet;

a main transport path for transporting the sheet via the image forming section;

at least two sub transport paths defined at a downstream side of the main transport path; and a sheet transport direction switching device, disposed between the main transport path and the sub transport paths, for switching a transport direction of the sheet between the at least two sub transport paths, as discharge destinations, wherein the sheet transport direction switching device includes a rotary guide member having a single guide passage for passing the sheet to be transported, and a support shaft extending in a direction orthogonal to the sheet transport direction, the rotary guide member being operable to change a posture thereof by pivotal movement about an axis of the support shaft so that an exit of the guide passage faces one of the at least two sub transport paths, a posture changing mechanism having a stepping motor for pivotally moving the rotary guide member about the axis of the support shaft, and operable to change the posture of the rotary guide member, and a controlling device for controlling an operation of the stepping motor, wherein the rotary guide member is movable to a receiving posture where the entrance of the guide passage is aligned in a predetermined direction, and the controlling device controls the stepping motor to move the rotary guide member to the receiving posture until the sheet is allowed to enter the entrance of the guide passage in the case where the sheet is guided in a state that the exit of the guide passage of the rotary guide member faces one of the two sub transport paths, so that the exit of the guide passage faces one of the two sub transport paths after the sheet is received in the entrance of the guide passage.

10. The image forming apparatus according to claim 9, further comprising:

a first discharge tray as a first discharge destination of the sheet; and a second discharge tray as a second discharge destination different from the first discharge destination, wherein the sub transport paths include a first sub transport path for transporting the sheet to the first discharge tray, and a second sub transport path for transporting the sheet to the second discharge tray.

11. The image forming apparatus according to claim 10, further comprising:

an inversion path for transporting the sheet in a backward direction to an upstream side of the main transport path with respect to the image forming section to perform a double-side printing operation; and a switchback section, disposed at a downstream side of the sheet transport direction switching device, for subjecting the sheet to a switchback operation to transport the sheet to the inversion path, wherein the sub transport paths include a third sub transport path for transporting the sheet to the switchback section.

12. The image forming apparatus according to claim 11, wherein the image forming apparatus is of an internal discharge type, the first discharge tray is an internal discharge tray, the image forming apparatus further includes a roller pair, disposed in the first sub transport path, for imparting a force to transport the sheet, and the roller pair is driven to rotate in a forward direction to transport the sheet to the internal discharge tray, and driven to rotate in a backward direction to transport the sheet to the inversion path.

13. The image forming apparatus according to claim 12, further comprising:

a controlling device for controlling an operation of the stepping motor, wherein the rotary guide member is so constructed that:

the single guide passage is defined by a pair of guide plates disposed opposite to each other with a certain clearance, an opening at one ends of the paired guide plates being defined as an entrance of the guide passage, and an opening at the other ends thereof being defined as an exit of the guide passage, at least one of the paired guide plates has a surface for defining the guide passage on the other side thereof, and a guide surface thereof for guiding the sheet, and the rotary guide member is movable to a receiving posture where the entrance of the guide passage is aligned in a predetermined direction, and the controlling device controls the stepping motor to move the rotary guide member to the receiving posture until the sheet is allowed to enter the entrance of the guide passage, in the case where the sheet is guided in a state that the exit of the guide passage faces one of the first sub transport path and the second sub transport path, and move the rotary guide member to a guiding posture for guiding the sheet along the guide surface, in the case where the sheet is transported to the inversion path.

14. The image forming apparatus according to claim 13, further comprising:

a sensor, disposed in the inversion path, for detecting whether the sheet has entered the inversion path, wherein the controlling device is operable to change the posture of the rotary guide member from the guiding posture to the receiving posture, in the case where a lead end of the sheet is detected by the second sensor.

15. An image forming apparatus comprising:

an image forming section for forming an image on a sheet;

a main transport path for transporting the sheet via the image forming section;

at least two sub transport paths defined at a downstream side of the main transport path; and a sheet transport direction switching device, disposed between the main transport path and the sub transport paths, for switching a transport direction of the sheet between the at least two sub transport paths, as discharge destinations; wherein the sheet transport direction switching device includes:

a rotary guide member having a single guide passage for passing the sheet to be transported, and a support shaft extending in a direction orthogonal to the sheet transport direction, the rotary guide member being operable to change a posture thereof by pivotal movement about an axis of the support shaft so that an exit of the guide passage faces one of the at least two sub transport paths;

a posture changing mechanism having a stepping motor for pivotally moving the rotary guide member about the axis of the support shaft, and operable to change the posture of the rotary guide member;

a first discharge tray as a first discharge destination of the sheet;

a second discharge tray as a second discharge destination different from the first discharge destination;

an inversion path for transporting the sheet in a backward direction to an upstream side of the main transport path with respect to the image forming section to perform a double-side printing operation; and a switchback section, disposed at a downstream side of the sheet transport direction switching device, for subjecting the sheet to a switchback operation to transport the sheet to the inversion path, wherein the sub transport paths include a first sub transport path for transporting the sheet to the first discharge tray, a second sub transport path for transporting the sheet to the second discharge tray, and a third sub transport path for transporting the sheet to the switchback section;

the image forming apparatus is of an internal discharge type;

the first discharge tray is an internal discharge tray;

the image forming apparatus further includes a roller pair, disposed in the first sub transport path, for imparting a force to transport the sheet; and the roller pair is driven to rotate in a forward direction to transport the sheet to the internal discharge tray, and driven to rotate in a backward direction to transport the sheet to the inversion path.

* * * * *